US011571063B2

(12) United States Patent
Taraka et al.

(10) Patent No.: US 11,571,063 B2
(45) Date of Patent: Feb. 7, 2023

(54) ADJUSTABLE ORGANIZER SHELF SYSTEM

(71) Applicant: Haier US Appliance Solutions, Inc., Wilmington, DE (US)

(72) Inventors: Shashidhar Taraka, Hyderabad (IN); Mahesh Swamulapalli, Hyderabad (IN); Madan Gopal Reddy Pathapati, Newburgh, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/177,622

(22) Filed: Feb. 17, 2021

(65) Prior Publication Data

US 2022/0257009 A1 Aug. 18, 2022

(51) Int. Cl.
*A47B 57/06* (2006.01)
*F25D 25/02* (2006.01)

(52) U.S. Cl.
CPC ..... *A47B 57/06* (2013.01); *F25D 25/02* (2013.01); *F25D 2325/021* (2013.01)

(58) Field of Classification Search
CPC ..... A47B 57/06; A47B 2088/901; A47B 2210/175; A47B 96/025; A47B 3/02; F25D 25/02; F25D 2325/021; F25D 25/04; F25D 25/021; F25D 25/024
See application file for complete search history.

(56) References Cited

U.S. PATENT DOCUMENTS 1,318,564 A * 10/1919 Jenkins ..... A47B 9/00 108/145
2,843,391 A * 7/1958 Pelletier ..... B25H 5/00 280/32.6
3,022,037 A * 2/1962 Stallard ..... A47C 3/34 248/421
6,427,607 B1 * 8/2002 Palmer ..... A47G 21/08 108/43
7,950,756 B2 5/2011 Baum
10,244,861 B1 * 4/2019 Poniatowski ..... A47B 9/16
2004/0040480 A1 * 3/2004 Hwang ..... A47B 3/02 108/145

(Continued)

FOREIGN PATENT DOCUMENTS

CN 105953516 B 3/2019
KR 20040059043 A 7/2004
KR 101649076 B1 8/2016

OTHER PUBLICATIONS

English translation for CN 105953516A (Year: 2019).*

*Primary Examiner* — Hiwot E Tefera
(74) *Attorney, Agent, or Firm* — Dority & Manning, P.A.

(57) ABSTRACT

Adjustable organizer shelf system and assemblies for use with an appliance are provided. Shelf assembly includes a pair of brackets and a fixed shelf mounted between the brackets. Shelf assembly also includes a movable shelf with a pair of rear lower hinges and a pair of lower guides. Shelf assembly also includes a lifting arm assembly attaching the movable shelf to the brackets. The lifting arm assembly can include a pair of lifting arms attached to each of the brackets. Lifting arm assembly also include an upper rear hinge affixed to each bracket, an upper guide affixed to each bracket, and a roller disposed within each of the upper guides and lower guides. The end of each lifting arm can be fastened to one of the rollers disposed with each of the guides.

13 Claims, 12 Drawing Sheets

(56) References Cited

U.S. PATENT DOCUMENTS

| | | | | |
|---|---|---|---|---|
| 2008/0271649 | A1* | 11/2008 | Leng | A47B 9/16 108/119 |
| 2013/0145972 | A1* | 6/2013 | Knox | B60N 2/24 108/145 |
| 2014/0265806 | A1* | 9/2014 | Hall | F25D 25/025 312/408 |
| 2015/0159803 | A1* | 6/2015 | Lin | B66F 7/065 108/50.11 |
| 2017/0174486 | A1* | 6/2017 | Kochie | B66F 7/08 |

* cited by examiner

ADJUSTABLE ORGANIZER SHELF SYSTEM

FIELD

The present disclosure relates generally to appliances and more particularly to adjustable organizer shelf systems for use in appliances, such as refrigerators.

BACKGROUND

Consumer appliances, such as refrigerator appliances, generally include a cabinet that defines one or more internal chambers. In the case of refrigerator appliances, a chilled chamber may be defined for receipt of food articles for storage. Consumer appliances can also include various storage components mounted within the one or more internal chambers. For example, refrigerator appliances can include various storage components within the chilled chamber, which are designed to facilitate storage of food items. Such storage components can include racks, bins, shelves, or drawers that receive food items and assist with organizing and arranging food items within the chilled chamber.

Some existing refrigerator appliances include one or more shelves for holding or supporting food items within the chilled chamber. Certain refrigerator appliances can include adjustable shelves that permit a user to change the positioning of the shelves. However, existing approaches to adjustable shelves present certain challenges and include limited adjustments or configurations that are not desirable for a particular consumer or application. For instance, existing adjustable shelves can include a single storage shelf divided into a fixed plate section and movable plate section, thus allowing adjustment of only a portion of the plates and leaving the fixed plate section to utilize and reduce storage capacity of the chilled chamber and reduce storage versatility in the chilled chamber.

Accordingly, an appliance with movable shelf features that address one or more of the challenges noted above or which provide additional shelf configurations would be useful and welcomed.

BRIEF DESCRIPTION

Aspects and advantages of embodiments of the present disclosure will be set forth in part in the following description, or may be learned from the description, or may be learned through practice of the embodiments.

One example aspect of the present disclosure an adjustable organizer shelf assembly for a consumer appliance, the shelf assembly defining a vertical direction, a lateral direction, and a transverse direction, the vertical, lateral, and transverse directions being mutually perpendicular. The shelf assembly includes a movable shelf. The movable shelf can be moved between a fully extended position and a fully retracted position.

Shelf assembly can also include a first bracket and a second bracket. A fixed shelf can be mounted to the first bracket and the second bracket. Shelf assembly can also include a movable shelf having a first rear lower hinge, a second rear lower hinge, a first lower guide and a second lower guide. Shelf assembly also has a first lifting arm assembly movably attaching the movable shelf to the first bracket. The first lifting arm assembly includes a plurality of lifting arms, a first upper rear hinge affixed to the first bracket, a first upper guide affixed to the first bracket, and a roller disposed within each of the first upper guide and the first lower guide. Shelf assembly also has a second lifting arm assembly movably attaching the movable shelf to the second bracket. The second lifting arm assembly includes a plurality of lifting arms, a second upper rear hinge affixed to the second bracket, a second upper guide affixed to the second bracket, and a roller disposed within each of the second upper guide and the second lower guide.

In some example embodiments, the first upper guide of shelf assembly has a channel, a guide surface disposed with the channel, and a cavity disposed within the channel. The cavity is formed, at least in part, by the guide surface. A stop bar can also be disposed within the cavity. The first upper guide can also include a plurality of passages formed in the guide surface and a plurality of nodules affixed to the stop bar. The nodules project through the passages from the cavity and into the channel.

In some example embodiments, the roller disposed within the first upper guide has a first circumferential edge and a second circumferential edge. The roller can also include a plurality of nodule reception cavities disposed between the first and second circumferential edges. The roller disposed within the first upper guide can also include a striking surface and a holding surface disposed within each of the plurality of nodule reception cavities.

In other example embodiments the first upper guide of the shelf assembly can have a channel, a guide surface disposed within the channel and a cavity disposed within the channel. The cavity is formed, at least in part, by the guide surface. The first upper guide can also include a plurality of depression stops formed in the guide surface. A transverse dimension of the depression stops can be based, at least in part, on an outside diameter of the roller disposed within the first upper guide.

In other example embodiments, the adjustable organizer shelf assembly can include a stabilizer assembly. Some embodiments include a cable stabilizer assembly. Other embodiments include a bar stabilizer assembly.

Another example embodiment of the present disclosure is directed to a refrigerator appliance including a cabinet defining a chilled chamber, a door being operably coupled to the cabinet to provide selective access to the chilled chamber, and an adjustable organizer shelf assembly positioned within the chilled chamber. The shelf assembly of refrigerator appliance includes a movable shelf. The movable shelf can be adjusted or moved between a fully extended position and a fully retracted position.

The adjustable organizer shelf assembly a fixed shelf includes a right bracket and a left bracket. A fixed shelf can be mounted to the right bracket and left bracket. A movable shelf can also be part of the shelf assembly. The movable shelf has a first rear lower hinge, a second rear lower hinge, a first lower guide and a second lower guide. Organizer shelf assembly can also have a first lifting arm assembly movably attaching the movable shelf to the right bracket. The first lifting arm assembly includes a plurality of lifting arms, a first upper rear hinge affixed to the right bracket, a first upper guide affixed to the right bracket, and a roller disposed within each of the first upper guide and the first lower guide. Organizer shelf assembly can also have a second lifting arm assembly movably attaching the movable shelf to the left bracket. The second lifting arm assembly includes a plurality of lifting arms, a second upper rear hinge affixed to the left bracket, a second upper guide affixed to the left bracket, and a roller disposed within each of the second upper guide and the second lower guide.

Additionally, one of the upper guides can include channel and a guide surface disposed with the channel. The upper guide can also include a cavity disposed within the channel.

The cavity can be formed, at least in part, by the guide surface. The shelf assembly can also include a stop bar disposed within the cavity. The upper guide can also include a plurality of passages formed in the guide surface and a plurality of nodules affixed to the stop bar. The stop bar can be mounted within the cavity such that the nodules project through the passages from the cavity into the channel.

The roller disposed within the upper guide can contain a pair of circumferential edges and a plurality of nodule reception cavities disposed between the circumferential edges. The roller disposed within the upper guide can also include a striking surface and a holding surface disposed with each of the plurality of nodule reception cavities. The adjustable organizer shelf assembly can further include a stabilizer assembly, such as a cable stabilizer assembly or bar stabilizer assembly.

In another example embodiment, shelf assembly can also include a pair of brackets and a fixed shelf mounted to the brackets. The movable shelf can have a pair of rear lower hinges and a pair of lower guides. Shelf assembly can also contain a lifting arm assembly attaching the movable shelf to the brackets. The lifting arm assembly also has a pair of lifting arms movably attached to each of the brackets, an upper rear hinge affixed to each bracket, an upper guide affixed to each bracket, and a roller disposed within each of the upper guides and lower guides. The end of each lifting arm can be fastened to one of the rollers.

In this example embodiment, one of the upper guides can include a channel and a guide surface disposed with the channel. The upper guide can also include a cavity disposed within the channel. The cavity can be formed, at least in part, by the guide surface. The guide surface can also include a plurality of depression stops formed in the guide surface and which project or extend into the cavity. In this example embodiment, a transverse dimension of the depression stops can be based, at least in part, on an outside diameter of the roller disposed within the upper guide.

Another example embodiment of the present disclosure is directed to a refrigerator appliance including a cabinet defining a chilled chamber, a door being operably coupled to the cabinet to provide selective access to the chilled chamber, and an adjustable organizer shelf assembly positioned within the chilled chamber. The shelf assembly of refrigerator appliance includes a movable shelf. The movable shelf can be adjusted or moved between a fully extended position and a fully retracted position.

Adjustable organizer shelf assembly can also include a pair of brackets and a fixed shelf mounted to the brackets. The movable shelf can have a pair of rear lower hinges and a pair of lower guides. Adjustable organizer shelf assembly can also include a lifting arm assembly attaching the movable shelf to the brackets. The lifting arm assembly also has a pair of lifting arms movably attached to each of the brackets, an upper rear hinge affixed to each bracket, an upper guide affixed to each bracket, and a roller disposed within each of the upper guides and lower guides. The end of each lifting arm can be fastened to one of the rollers.

One of the upper guides can include channel and a guide surface disposed with the channel. The upper guide can also include a cavity disposed within the channel. The cavity can be formed, at least in part, by the guide surface. The shelf assembly can also include a stop bar disposed within the cavity. The upper guide can also include a plurality of passages formed in the guide surface and a plurality of nodules affixed to the stop bar. The stop bar is mounted within the cavity such that the nodules project through the passages from the cavity into the channel. The roller disposed within the upper guide can include a pair of circumferential edges and a plurality of nodule reception cavities disposed between said circumferential edges. The roller disposed within the upper guide can also include a striking surface and a holding surface disposed with each of the plurality of nodule reception cavities. The adjustable organizer shelf assembly can further include a stabilizer assembly such as a cable stabilizer assembly or bar stabilizer assembly.

According to yet another exemplary embodiment, a shelf assembly, the shelf assembly defining a vertical direction, a lateral direction, and a transverse direction, the vertical, lateral, and transverse directions being mutually perpendicular. The shelf assembly includes a pair of brackets and a fixed shelf mounted to the pair brackets. Shelf assembly can also have a rear upper hinge mounted to each bracket and an upper guide mounted to each bracket. The movable shelf also incorporates a pair of rear lower hinges and a pair of lower guides. A roller may be disposed within each of the upper guides and each of the lower guides.

The shelf assembly also includes a lifting arm assembly movably attached to each bracket. The lifting arm assembly includes a first lifting arm and a second lifting arm. The first lifting arm and second lifting arm of each of the pair of lifting arm assemblies is mechanically attached at a pivot joint. Each of the first lifting arms is attached to a rear upper hinge and the roller disposed within one of the pair of lower guides. Each of the second lifting arms is attached to a rear lower hinge and the roller disposed within one of the pair of upper guides.

Variations and modifications can be made to these example aspects of the present disclosure. These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

Figure 1:
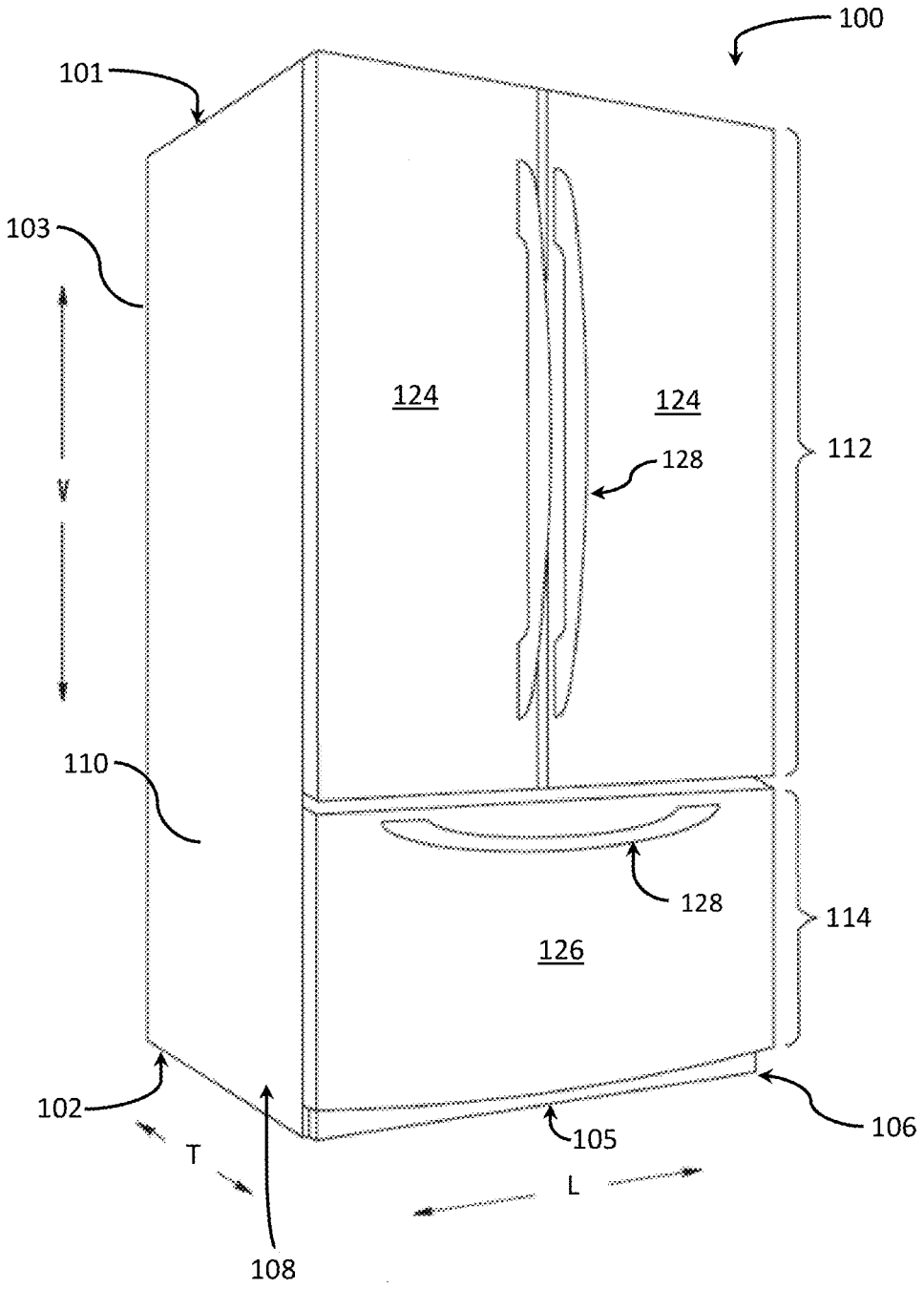
FIG. 1 depicts a front perspective view of a refrigerator appliance according to exemplary embodiments of the present disclosure.

Repeat use of reference characters in the present specification and drawings is intended to represent the same or analogous features or elements of the present disclosure.

DETAILED DESCRIPTION

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

As used herein, terms of approximation, such as "approximately," "substantially," or "about," refer to being within a ten percent margin of error.

Referring now to the figures, example aspects of the present disclosure will be discussed in greater detail.

FIG. 1 provides a perspective view of a refrigerator appliance 100 according to an exemplary embodiment of the present subject matter. Refrigerator appliance 100 defines a vertical direction V, a lateral direction L, and a transverse direction T. The vertical, lateral, and transverse directions V, L, and T are mutually perpendicular and form an orthogonal direction system.

Refrigerator appliance 100 includes a base cabinet or housing 110 that extends between a top portion 112 and a bottom portion 114 along the vertical direction V. Housing 110 defines a chilled chamber for receipt of food items for storage. In particular, housing 110 defines fresh food chamber 120 (shown in FIG. 2) positioned at or adjacent top portion 112 of housing 110 and a freezer chamber (not shown) arranged at or adjacent bottom portion 114 of housing 110. As such, refrigerator appliance 100 is generally referred to as a bottom mount refrigerator appliance or a bottom freezer refrigerator appliance. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

Housing 110 also extends between a right side portion 106 and a left side portion 108, e.g., along the lateral direction L, forming a front portion 105. Housing 110 defines an opening 140 (shown in FIG. 2) for accessing fresh food chamber 120 (shown in FIG. 2) at or adjacent front portion 105 of housing 110. Housing 110 also includes a back wall 103 extending between a bottom portion 102 and a top portion 101, e.g., along the vertical direction V. Housing 110 also includes a left side portion 108 and a right side portion 106, both of which extend between a front portion 105 and a back wall 103, e.g., along the transverse direction T.

Refrigerator doors 124 are rotatably mounted or hinged to an edge of housing 110, e.g., at front portion 105 of housing 110, for selectively accessing chilled chamber 120. In addition, a freezer door 126 is arranged below refrigerator doors 124 for selectively accessing freezer chamber (not shown). Freezer door 126 is coupled to a freezer drawer (not shown) slidably mounted within freezer chamber (not shown). Refrigerator doors 124 are shown in an closed position and freezer door 126 are shown in a closed position in FIG. 1. When moved to an open position, refrigerator doors 124 permit access to chilled chamber 120 (shown in FIG. 2) through opening 140. Conversely, refrigerator doors 124 obstruct or limit access to chilled chamber 120 through opening 140 in the closed position in FIG. 1. Freezer door 126 operates similarly. Handles 128 can assist with operating refrigerator doors 124 and freezer door 126 between the open and closed positions.

Figure 2:
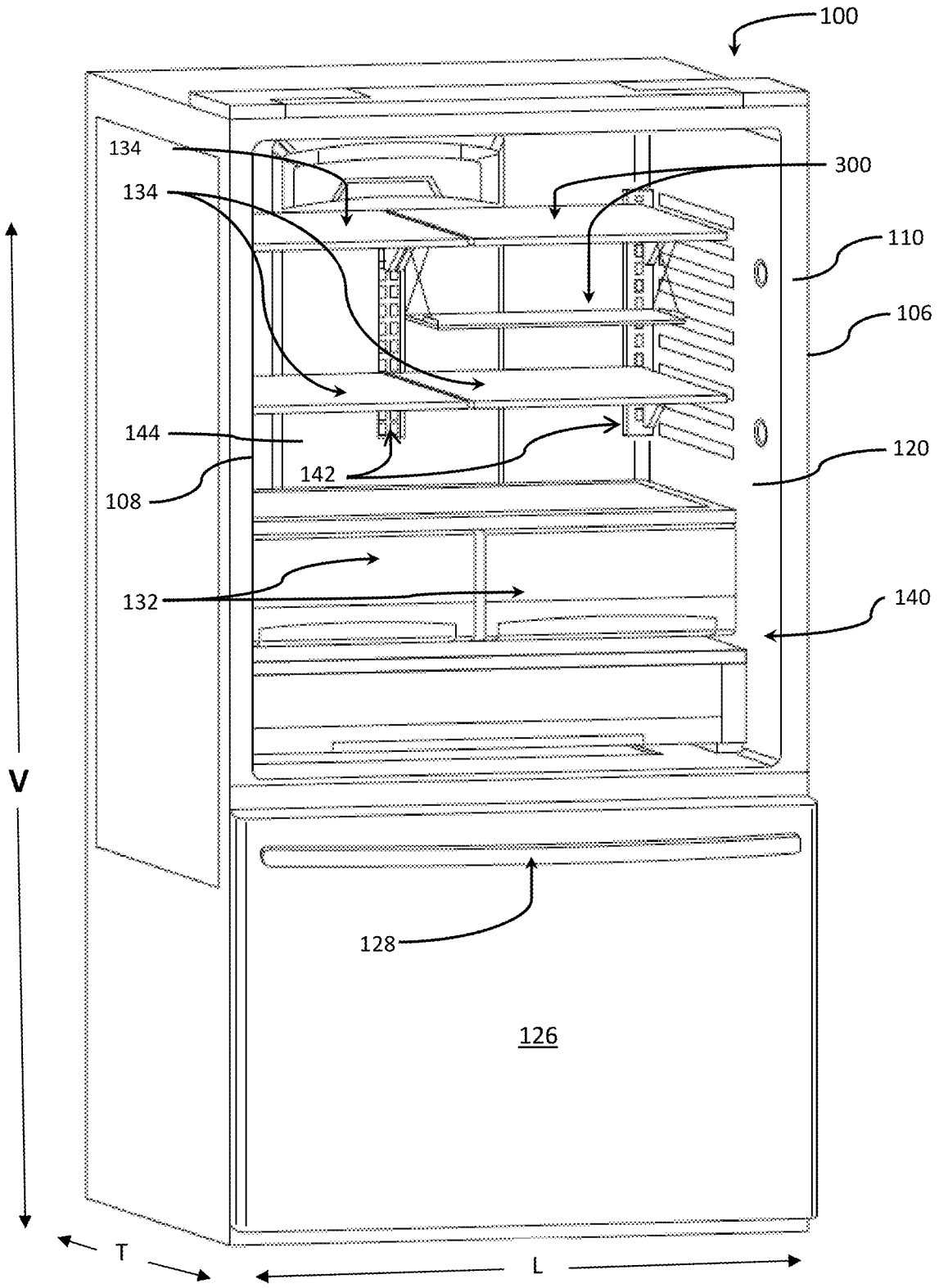
FIG. 2 depicts a perspective view of a refrigerator appliance according to an exemplary embodiment of the present disclosure with doors of the refrigerator appliance removed to reveal certain components of the exemplary refrigerator appliance of FIG. 1.

FIG. 2 depicts a perspective view of a refrigerator appliance according to an exemplary embodiment of the present subject matter with doors 124 of the refrigerator appliance removed to reveal certain components within fresh food chamber 120 of the exemplary refrigerator appliance of FIG. 1.

Various storage components are mounted within chilled chamber 120 to facilitate storage of food items therein as will be understood by those skilled in the art. In particular, the storage components include bins (not shown), drawers 132, and shelves 134 that are mounted within chilled chamber 120. Bins (not shown), drawers 132, and shelves 134 are configured for receipt of food items (e.g., beverages and/or solid food items) and may assist with organizing such food items. As an example, drawers 132 can receive fresh food items (e.g., vegetables, fruits, and/or cheeses) and increase the useful life of such fresh food items. Refrigerator 100 can also include an adjustable organizer shelf assembly 300.

Although the illustrated embodiment shows two shelves 134 positioned adjacent each other along the lateral direction L and a shelf 134 positioned adjacent to adjustable organizer shelf assembly 300, that are positioned adjacent to shelves 134 along the vertical direction V, it should be appreciated that aspects of the present disclosure may be applied to other shelf assembly styles and configurations. For example, shelves 134 or adjustable organizer shelf assembly 300 could instead include a single storage shelf extending from the right side portion 106 to the left side portion 108 of refrigerator 100 along a lateral direction L. In addition, shelves 134 and additional shelves 134 may have any other suitable sizes or configurations. Moreover, it should be appreciated that adjustable organizer shelf assembly 300 as described herein may be utilized as one or more of shelves 134, and adjustable organizer shelf assembly 300 is designed such that shelves 134 may be interchangeable within the chilled chamber 120 and can be positioned at mounting points 142 affixed to a cabinet wall 110, or any other suitable mounting point or location within chilled chamber 120.

Figure 3:
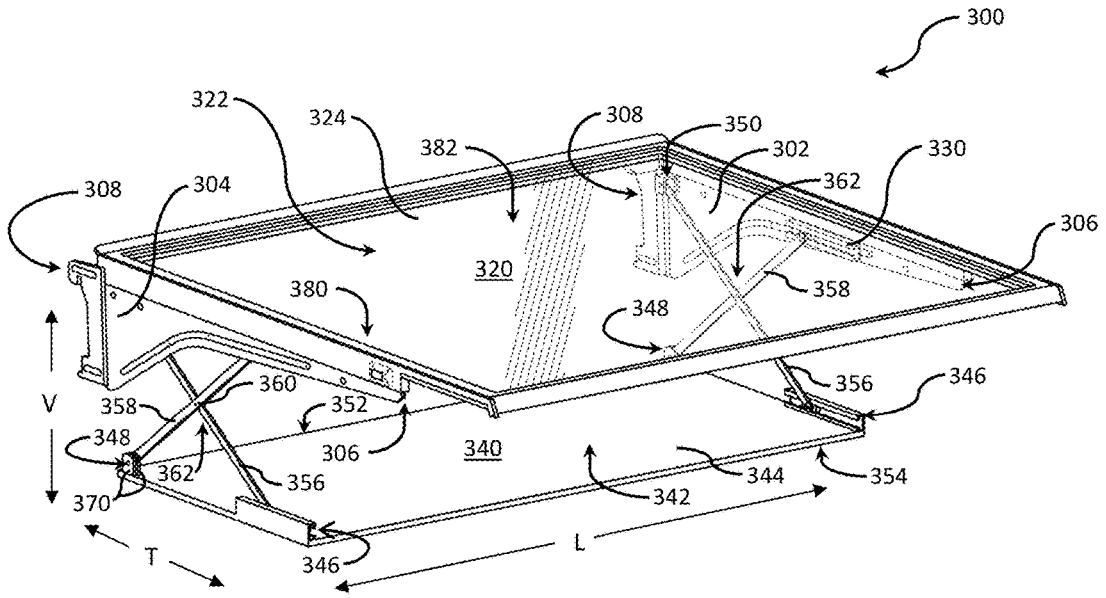
FIG. 3 depicts a perspective view of an adjustable organizer shelf assembly according to an exemplary embodiment of the present subject matter with the movable shelf shown in a fully extended position.
Figure 4:
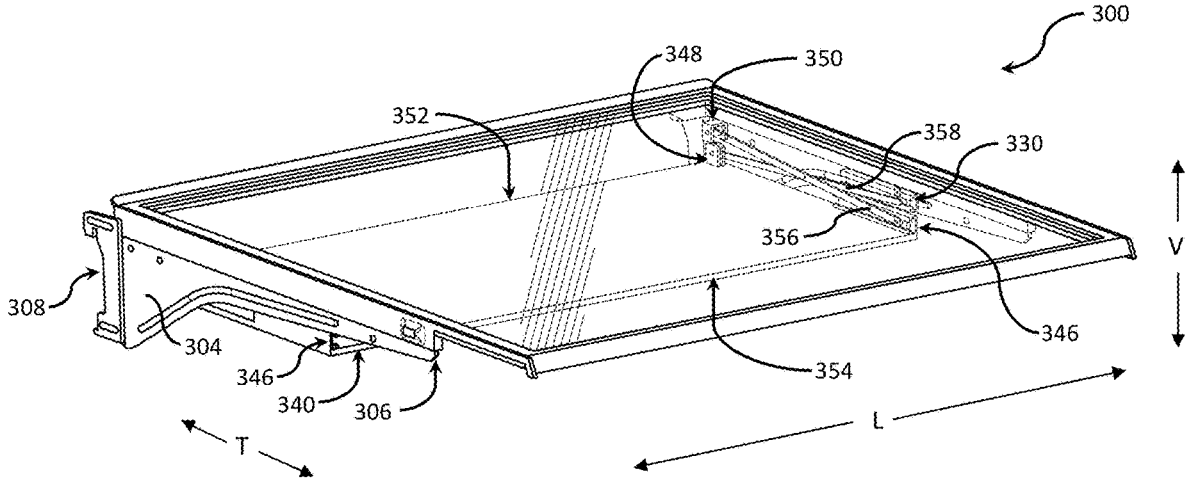
FIG. 4 depicts a perspective view of the adjustable organizer shelf assembly of FIG. 3 with the movable shelf shown in a fully retracted position.

Referring now generally to FIGS. 3 and 4. FIG. 3 provides a perspective view of an adjustable organizer shelf assembly 300 according to an exemplary embodiment of the present subject matter. Adjustable organizer shelf assembly 300 is configured for use in any suitable refrigerator appliance. As an example, adjustable organizer shelf assembly 300 may be positioned within chilled chamber 120 of refrigerator appliance 100 and utilized in place of one or more of shelves 134. In FIG. 3, adjustable organizer shelf assembly 300 is shown with a movable shelf 340 of shelf assembly 300 in a fully extended position. In FIG. 4, adjustable organizer shelf assembly 300 is shown with movable shelf 340 in a fully retracted position. Aspects of movable shelf 340 are discussed in greater detail below.

FIG. 3 depicts a perspective view of adjustable organizer shelf assembly 300 according to an exemplary embodiment of the present subject matter. Adjustable organizer shelf assembly 300 includes a pair of side supports, such as right-side bracket 302 and left-side bracket 304. Right-side bracket 302 and left-side bracket 304 are spaced apart from each other, e.g., along the lateral direction L, and attached to the sides of fixed shelf 320. Right-side bracket 302 and left-side bracket 304 can be mounted to interior rear wall 144 of chilled chamber 120, e.g., at mounting points 142 (shown in FIG. 2). It should be appreciated that brackets (302 and 304) could be mounted to rear wall 144 in other suitable locations. In particular as shown in FIG. 3, brackets (302 and 304) extend between a proximate end portion 306 and a distal end portion 308, e.g., along the transverse direction T. Distal end portion 308 of brackets (302 and 304) can be positioned at or attached to mounting points 142 (shown in FIG. 2) affixed to rear cabinet wall 144. As such, proximate end portion 306 of brackets (302 and 304) can positioned within chilled chamber 120, e.g., adjacent to the front portion 105 of cabinet 110.

A fixed shelf 320 is mounted to and between brackets (302 and 304). Thus, fixed shelf 320 extends between right-side bracket 302 and left-side bracket 304, e.g., along the lateral direction L. A plurality of fasteners (not shown), e.g., screws, bolts, and/or clips, couple fixed shelf 320 to brackets 302 and 304. Fixed shelf 320 can include a fixed plate 322 having a top surface 324. Plate 322 can be formed from glass, plastic, metal or another suitable material. Food items can be placed on and/or stored on top surface 324 of fixed plate 322, e.g., within chilled chamber 120. Brackets 302 and 304 each have an upper guide 330 that extends along at least a portion of bracket 302 and bracket 304 in the transverse direction T. A plurality of fasteners 710 (shown in FIG. 7), e.g., screws, bolts, and/or clips, couple or affix an upper guide 330 to each of brackets 302 and 304. Alternatively, upper guides 330 can be integrally formed with brackets 302 and 304.

Adjustable organizer shelf 300 can also include a pair of rear upper hinges 350 situated at or near the distal end 308 of brackets 302 and 304. Rear upper hinges 350 can be integrally formed with brackets 302 and 304 or coupled to each of brackets 302 and 304 by a known fastening method, e.g., welding, adhesive, screws, bolts, and/or clips.

Figure 5:
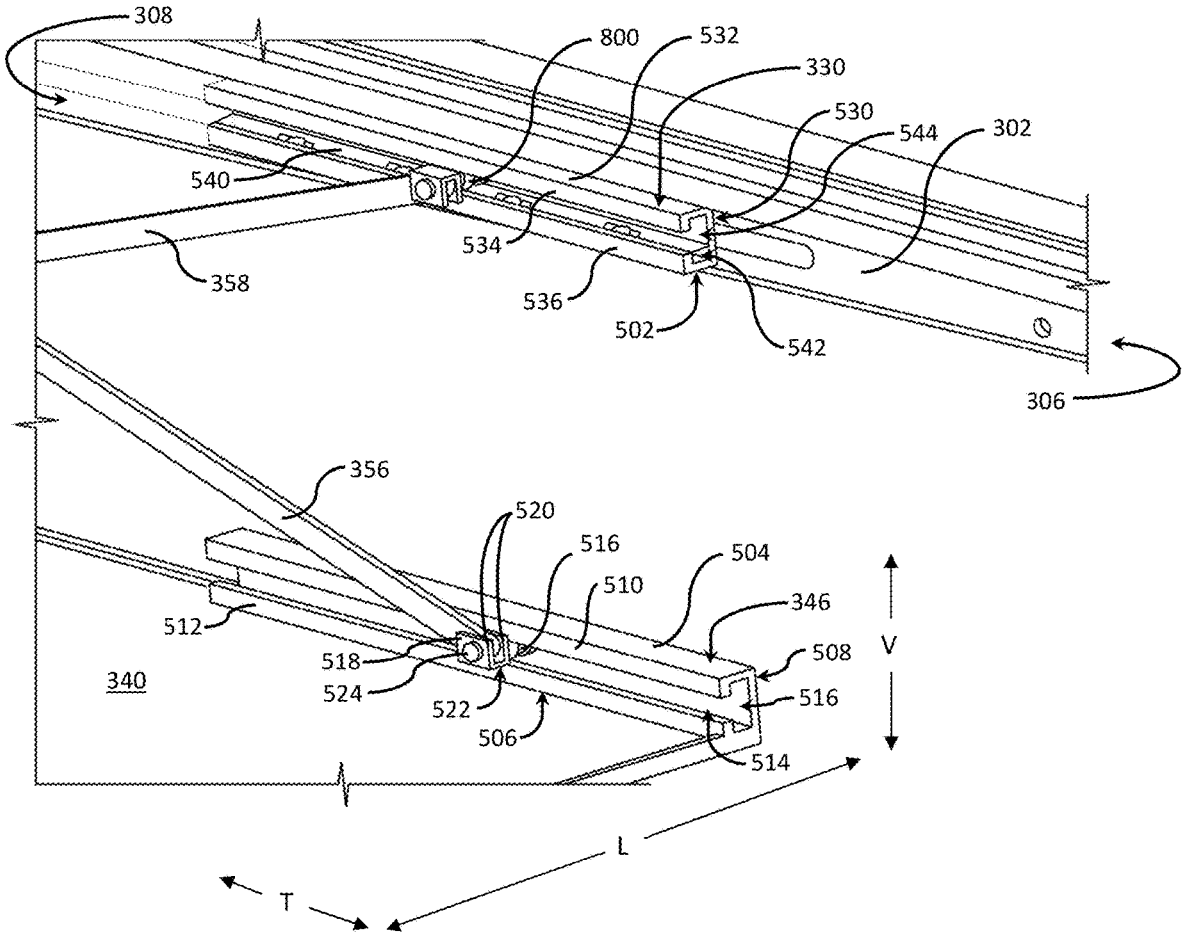
FIG. 5 depicts a partial perspective view of the adjustable organizer shelf assembly of FIG. 3 with the movable shelf of the shelf assembly shown in a partially extended position and without the inclusion of the top plate of the fixed shelf, in order to provide an unobstructed view of the upper guide, front channel and a portion of a lifting assembly of the adjustable organizer shelf assembly of FIG. 3.

Movable shelf 340 is positioned below fixed shelf 320, in the vertical direction V, and can be moved up and down along the vertical direction V relative to fixed shelf 320 as described further herein. Movable shelf 340 includes a plate 342 having a top surface 344. Plate 342 can be formed from glass, polycarbonate, metal or any other known material suitable for use a refrigerator shelving. Movable shelf 340 is selectively adjustable, up and down along the vertical direction V, by a user between the fully extended position shown in FIG. 3 and the fully retracted position shown in FIG. 4. Movable shelf 340 can also be selectively adjusted to one or more partially extended positions (such as shown in FIG. 5) which are between the fully retracted and fully extended positions based on the configurations of the stop bar nodules 612 (shown in FIGS. 6 and 7) or depression stops 924 (shown in FIGS. 10 and 11). Food items can be placed on and/or stored on top surface 344 of plate 342, e.g., within fresh food chamber 120, when movable shelf 340 is in the extended position or in a partially extended position. Further, top surface 324 of fixed shelf 320 and top surface 344 of movable shelf 340 can be substantially parallel when movable shelf 340 is in the fully extended position, fully retracted position or any of the one or more partially extended positions. Top surface 324 of fixed shelf 320 and top surface 344 of movable shelf 340 can remain substantially parallel when movable shelf 340 is being moved by a user between the fully extended position, fully retracted position or any of the one or more partially extended positions.

In some embodiments of the present disclosure, when the movable shelf 340 is in the retracted position, the distance in a vertical direction V between movable plate 342 and fixed shelf 320 is such that top surface 344 is not suitable for storage of food items. In other embodiments of the present disclosure, when the movable shelf 340 is in the fully retracted position, upper guides 330 and lower guides 346 come into physical contact or are in close proximity as depicted in FIG. 4. More specifically, bottom member 502 (shown in FIG. 5) of upper guides 330 can physically contact or be in close proximity to top member 504 (shown in FIG. 5) of lower guides 346.

Movable shelf 340 has a proximate end 354 and a distal end 352. Movable shelf 340 has a pair of lower guides 346 situated at or near the proximate end 354 of movable shelf 340. Movable shelf 340 has a pair of rear lower hinges 348 situated at or near the distal end 352 of movable shelf 340. Lower guides 346 and rear lower hinges 348 can be integrally formed with plate 342 to form a unitary movable shelf 340. In other embodiments, lower guides 346 and rear lower hinges 348 can be coupled or affixed to plate 342, to form movable shelf 340, by any method suitable for the material used to construct or form movable shelf 340, such as welding, adhesive, screws, bolts, and/or clips.

Adjustable organizer shelf 300 also includes one or more lifting arm assemblies 362, which include a first lifting arm 356 and a second lifting arm 358. Adjustable organizer shelf 300 can include a lifting arm assembly 362 disposed near each bracket 302 and 304. More specifically a first lifting assembly 362 can be movably attached to right-side bracket 302 and a second lifting assembly 362 can be movably attached to left-side bracket 304. For each lifting arm assembly 362, a first lifting arm 356 extends between the rear upper hinge 350 and the lower guide 346 of movable shelf 340. For each lifting arm assembly 362, second lifting arm 358 extends between rear lower hinge 348 and upper guide 330. Each lifting arm 356 and 358 includes a pin slot configured to accept or receive a pin (such as pin 610), screw, rivet or other similar device. Lifting arms (i.e., first lifting arm 356 and second lifting arm 358) of lifting arm assembly 362 are connected at a pivot joint 360 such that lifting arms 356 and 358 form an "X" pattern or scissor mechanism. Pivot joint 360 is formed by the insertion of a pin, screw, rivet or other suitable devices through the pin hole of first lifting arm 356 and second lifting arm 358. The pin mechanically attaches first lifting arm 356 and second lifting arm 358 at the pivot joint 360. Pivot joint 360 allows both lifting arms 356 and 358 to pivot or rotate about an axis formed along lateral direction L by the pin of the pivot joint 360.

Lifting arm assemblies 362 engage upper guides 330, lower guides 346, rear lower hinge 348 and rear upper hinge 350 in order to facilitate movement of movable shelf 340, e.g., along the vertical direction V, as described in greater detail below.

Rear upper hinges 350 include two side supports 364 (shown in FIG. 15), extending downward in the vertical direction V away from fixed shelf 320, and a top support 366 (shown in FIG. 16) extending between the side supports 364 to form a "U" shape. Rear upper hinges 350 are configured to accept a portion of first lifting arm 356 and secure first lifting arm 356 to rear upper hinge 350. Each side support 364 includes a pin hole 368 configured to allow insertion of a pin 372, screw, rivet or other suitable devices through pin hole 368 and through first lifting arm 356. The pin mechanically attaches first lifting arm 356 and rear upper hinge 350 and allows first lifting arm 356 to pivot or rotate about the pin.

Similarly, rear lower hinges 348 include two side supports 370, extending upward in the vertical direction V away from movable shelf plate 342, and a bottom support (not shown and when lower hinge is integrally formed with movable shelf plate 342, bottom support of rear lower hinge 348 may be movable shelf plate 342) extending between the side supports 370 to form a "U" shape. Rear lower hinges 348 are configured to accept a portion of second lifting arm 358 and secure second lifting arm 358 to rear lower hinge 348. Each side support 370 includes a pin hole configured to allow insertion of a pin, screw, rivet or other suitable devices through each pin hole and through second lifting arm 358. The pin mechanically attaches second lifting arm 358 and rear lower hinge 348 and allows second lifting arm 358 to pivot or rotate about the pin.

Figure 6:
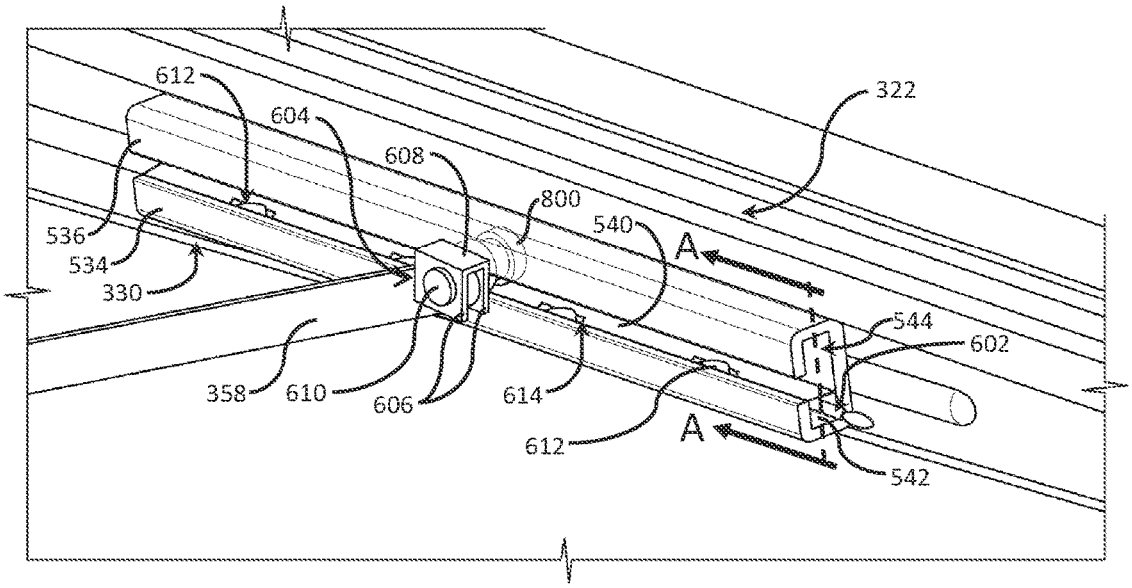
FIG. 6 depicts a partial perspective view of an upper guide of the shelf assembly of FIG. 3 without the inclusion of the top plate of the fixed shelf, in order to provide an unobstructed view of an upper guide and a portion of a lifting bar of the adjustable organizer shelf assembly of FIG. 3.
Figure 7:
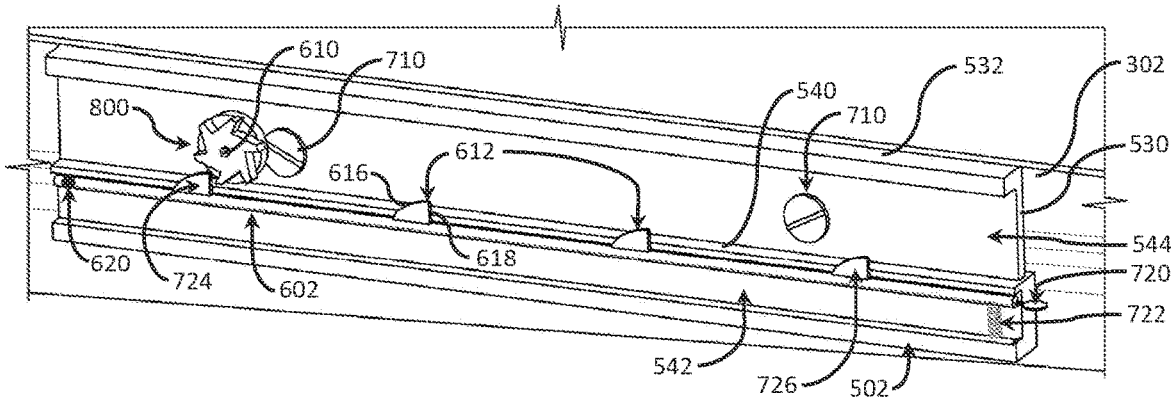
FIG. 7 depicts a partial section view of an upper guide of the adjustable organizer shelf assembly of FIG. 3 taken along the A-A section line of FIG. 6.

Referring now generally to FIGS. 5, 6 and 7. FIG. 5 depicts a partial perspective view of the adjustable organizer shelf assembly 300 of FIG. 3 with the movable shelf 340 of the shelf assembly shown in a partially extended position and without the inclusion of the fixed plate 322 of the fixed shelf 320, in order to provide an unobstructed view of the upper guide 330, lower guide 346 and a portion of a lifting arm assembly 362. FIG. 6 depicts a partial perspective view of upper guide 330 of the adjustable organizer shelf assembly 300 of FIG. 3 without the inclusion of the fixed plate 322, in order to provide an unobstructed view of upper guide 330 and a portion of second lifting arm 358 of the adjustable organizer shelf assembly 300 of FIG. 3.

Each lower guide 346 includes a bottom member 364 that rests on and/or is affixed to movable shelf plate 342. Lower guide 346 affixed to the portion of the movable shelf plate 342 situated near the right-side bracket 302 is depicted in FIG. 5. However, it would be appreciated by one of skill in the art that lower guide 346 affixed to movable shelf plate 342 situated near left-side bracket 304 has the same features described herein. Lower guide 346 and bottom member 506 thereof extend in a transverse direction T along top surface 344 of movable shelf 340 from the proximate end 354 of movable shelf 340 toward the distal end 352 of movable shelf 340. Each lower guide 346 includes an outside member 508 which extends upward, in a vertical direction V, from bottom member 506 and extends in a transverse direction T along top surface 344 from the proximate end 354 of movable shelf toward distal end 352 of movable shelf. Top member 504 of lower guide 346 extends from outside member 508 in a lateral direction L toward center of movable shelf 340. Each lower guide 346 further includes a first inner member 510 and second inner member 512. First inner member 510 extends downward, in a vertical direction V, from top member 504. Second inner member 512 extends upward, in a vertical direction V, from bottom member 364. First inner member 510 and second inner member 512 are separated in a vertical direction V to define a slot 514. Slot 514 extends along the transverse direction T between first inner member 510 and second inner member 512. Bottom member 364 and top member 504, face each other, e.g., along the vertical direction. Outside member 508 and first inner member 510, face each other, e.g., along the lateral direction. Bottom member 364, outside member 508, top member 504, first inner member 510 and second inner member 512 define a channel 516. Channel 516 extends in a transverse direction T along top surface 344 from the proximate end 354 of movable shelf toward distal end 352 of movable shelf.

In the embodiment depicted in FIG. 5, channel 516 is a "C" shape, however, channel 516 can be any other shape configured capable of accept roller, such as roller 516. Roller 516 can be any suitable wheel, cylinder or other shape that is capable of rolling or moving within channel 516 along transverse direction T along. Roller 516 is attached to lower roller hinge 518. Lower roller hinge 518 includes two side supports 520, extending upward in the vertical direction V away from movable shelf plate 342, and a bottom support 522 extending between the side supports 364 to form a "U" shape facing upward in vertical direction V.

Lower roller hinge 518 is configured to accept a portion of first lifting arm 356 between hinge side supports 520 and secure first lifting arm 356 to lower roller hinge 518. Each hinge side support 520 includes a pin hole (not shown) configured to allow insertion of a pin 524, screw, rivet or other suitable devices through each pin hole (not shown) and through first lifting arm 356. Pin 524 mechanically attaches first lifting arm 356 and lower roller hinge 350 in such a manner as to allow first lifting arm 356 to pivot or rotate about pin 524.

Each upper guide 330 includes a bottom member 502. Upper guide 330 affixed to right-side bracket 302 as depicted in FIG. 5. However, it would be appreciated that upper guide 330 can also be affixed to left-side bracket 304 and has the same or similar features as described with respect upper guide 330 depicted in FIG. 5. Bottom member 502 extends in a transverse direction T from the proximate end 306 of bracket 302 toward the distal end 308 of bracket 302. Each upper guide 330 includes an outside member 530 which extends upward, in a vertical direction V, from bottom member 502 and extends in a transverse direction T along bracket 302 from the proximate end 306 of bracket toward distal end 308 of bracket. Top member 532 of upper guide 330 extends from outside member 530 in a lateral direction L inward toward center of fixed shelf 320. Each upper guide 330 further includes a first inner member 534 and second inner member 536. First inner member 534 extends downward, in a vertical direction V, from top member 532. Second inner member 534 extends upward, in a vertical direction V, from bottom member 502. First inner member 534 and second inner member 536 are separated in a vertical direction V to define a slot 538. Slot 538 extends along the transverse direction T between first inner member 534 and second inner member 536. Bottom member 502 and top member 532 face each other, e.g., along the vertical direction V. Outside member 530 faces first inner member 534 and second inner member 536, e.g., along the lateral direction L. Upper guide 330 includes a guide surface 540 which extends between second inner member 536 and outside member 530 in the lateral direction L and the transverse direction T.

Bottom member 502, outside member 530, guide surface 540, and second inner member 512 define a cavity 542. In the exemplary embodiment depicted in FIGS. 5 and 6, cavity 542 is a square or rectangular shape, however, cavity 542 can be any other shape configured to accept stop bar 602 (shown in FIGS. 6 and 7). Guide surface 540, outside member 530, top member 532 and first inner member 534 define a channel 544. Channel 544 extends in a transverse direction T along top surface 344 from the proximate end 354 of movable shelf toward distal end 352 of movable shelf.

In the embodiment depicted in FIGS. 5 and 6, channel 544 is an inverted "L" shape, however, channel 544 can be any other shape configured capable of accepting a roller, such as roller 800. Roller 800 is depicted in further detail in FIGS. 8 and 9. Roller 800 is configured to roll or moving on guide service 540 and within, at least a portion of channel 544 along transverse direction T. Roller 800 is attached to upper roller hinge 604. Upper roller hinge 604 includes two side supports 606, extending downward in the vertical direction V away from fixed shelf plate 322, and a top support 608 extending between the side supports 606 to form an inverted "U" shape facing downward in vertical direction V.

Upper roller hinge 604 is configured to accept a portion of second lifting arm 358 between hinge side supports 606 and secure second lifting arm 358 to upper roller hinge 604. Each hinge side support 606 includes a pin hole (not shown) configured to allow insertion of a pin 610 through each pin hole (not shown) and through second lifting arm 358. Pin 610 mechanically attaches second lifting arm 358 and upper roller hinge 604 in such a manner as to allow second lifting arm 358 to pivot or rotate about pin 610.

Upper guide 330 of adjustable organizer shelf 300 includes stop bar 602. Stop bar 602 includes a plurality of nodules 612. Guide surface 540 includes a plurality of passages 614 corresponding to each of the plurality of nodules 612. Passages 614 extend between cavity 542 and channel 544 in a vertical direction V. Each of the plurality of nodules 612 can pass through passages 614 from cavity 542, such that nodules 612 protrude upward, in the vertical direction V, into channel 544 through passages 614 or retract downward, in the vertical direction V, into cavity 542.

FIG. 7 depicts a partial section view of upper guide 330 of the adjustable organizer shelf assembly 300 of FIG. 3 taken along the A-A section line of FIG. 6. Stop bar 602 is pivotally attached or joined to upper guide 330 at hinge point 620 which is disposed within cavity 542. Hinge point 620 can be a pin, screw, rivet or other suitable device which facilitates pivotable attachment of stop bar 602 to upper guide 330. Each nodule 612 includes a striking surface 616 and holding surface 618. A handle 720 is attached to stop bar 602. Handle 720 extends outside of cavity 542 and can be engaged (e.g., depressed or pushed in a downward vertical direction V) by a user. Stop bar 602 includes a stop nodule 724, which is one of the plurality of nodules 612 situated closet to hinge point 620. Stop bar 602 includes a storage nodule 726, which is one of the plurality of nodules 612 situated closet to handle 720. Upper guide 330 can also include spring 722 which is situated between bottom member 502 and stop bar 602. In some embodiments spring 722 can be located at an end of stop bar 602 closest to handle 720. Spring 722 exerts force against stop bar 602 upward in a vertical direction V such that nodules 612 protrude through passages 614 into channel 544. When a user engages handle 720 (e.g, by pressing down on handle 720), stop bar 602 rotates at hinge point 620 and compresses spring 722 such that each of the plurality of nodules 612, except stop nodule 724, retract into cavity 542. In this way roller 800 can move along guide surface 540 between stop nodule 724 and storage nodule 726. Movable shelf 340 can be in a fully extended position when holding surface 904 (shown in FIG. 9) of roller 800 is in contact with holding surface 618 of stop nodule 724 (as shown in FIG. 7). Similarly, movable shelf 340 can be in a fully retracted position when holding surface 904 (shown in FIG. 9) of roller 800 is in contact with holding surface 618 of storage nodule 726.

Figure 8:
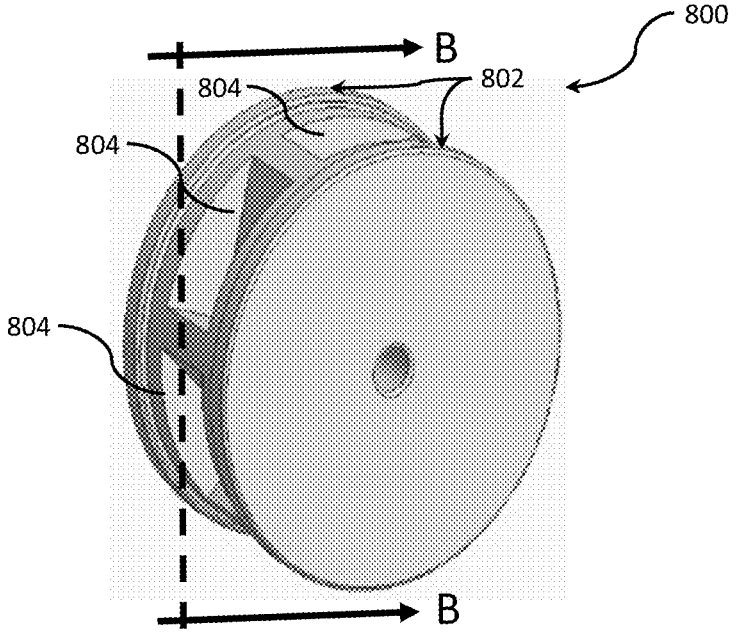
FIG. 8 depicts a perspective view of a roller which is disposed within an upper guide of the shelf assembly of FIG. 3.
Figure 9:
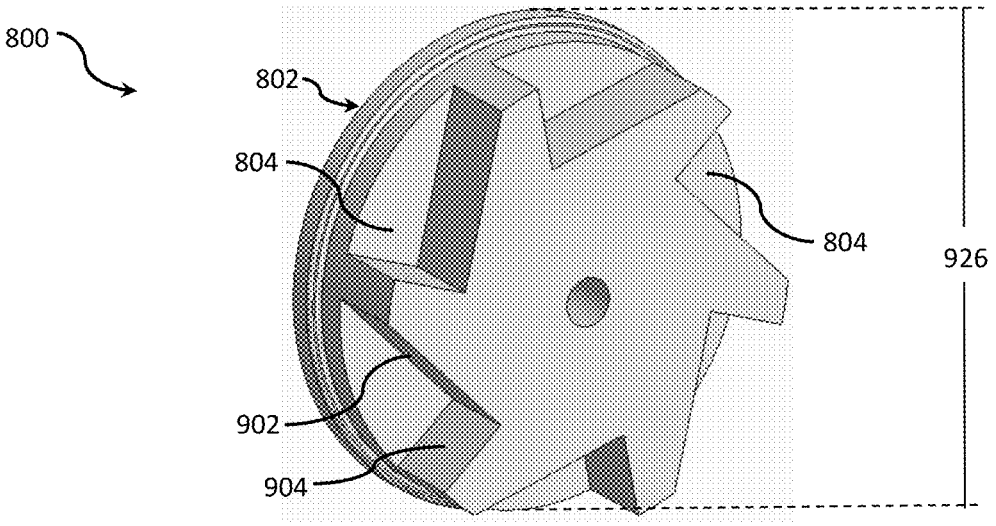
FIG. 9 depicts a partial section view of a roller of an upper guide of the shelf assembly of FIG. 3 taken along the B-B section line of FIG. 8.

Referring now generally to FIGS. 8 and 9. FIG. 8 depicts a perspective view of roller 800 of the upper guide 300 of adjustable organizer shelf assembly 300 of FIG. 3. Roller 800 includes circumferential edges 802. Edges 802 contact and roll upon guide surface 540 of upper guide 330. Roller 800 includes a plurality of nodule reception cavities 804, situated between the circumferential edges 802 and formed by striking surface 902 and holding surface 904 (shown in FIG. 9). Nodule reception cavities 804 are configured such that nodule 612, or at least a portion thereof, can be accepted in each of the nodule reception cavities 804 (shown in FIG. 7).

FIG. 9 depicts a partial section view of a roller 800 of the upper guide 330 of the adjustable organizer shelf assembly 300 of FIG. 3 taken along the B-B section line of FIG. 8. Each nodule reception cavity 804 includes a striking surface 902 and holding surface 904 (shown in FIG. 9).

Referring again generally to FIGS. 5, 6 and 7, when holding surface 904 of roller 800 contacts holding surface 618 of nodule, roller 800 is prevented from moving in a transverse direction T toward the distal end 308 of brackets 302 and 304. In this way, upper guide 330 prevents second lifting arm 358 and first lifting arm 356 from rotating or pivoting at pivot joint 360. For example, FIG. 7 depicts holding surface 618 of stop nodule 724 in contact with holding surface 904 of roller 800 thereby preventing roller 800 from moving past stop nodule 724 in a transverse direction T toward distal end 308 of bracket 302.

As discussed above, movable shelf 340 is movable between a fully extended position (shown in FIG. 3) and a fully retracted position (shown in FIG. 4). A user can move movable shelf 340 up (e.g., toward a fully retracted position) by placing upward force on shelf 340 in a vertical direction V. Such upward force from the user will cause second lifting arm 358 to push roller 800 within upper guide 330 in a transverse direction T toward the proximate end of bracket 302. When roller 800 is moving in a transverse direction toward proximate end 306 of bracket 302, striking surface 902 of roller 800 will contact striking surface 616 of stop bar nodules 612. Such contact between striking surface 902 and striking surface 616 push stop bar nodules 612 in a downward vertical direction V through passages 614 and into cavity 542, thereby allowing roller 800 to move past nodule 612 in a transverse direction T. Once roller 800 moves past passage 614 in a transverse direction T toward proximate end 306 of bracket 302, spring 722 exerts a vertical force against stop bar 602 causing nodules 612 to extend back through passages 614 into channel 544.

User can select the vertical position of movable shelf 340 relative to fixed shelf 320 by selectively engaging a nodule reception cavity 804 of roller 800 with the nodule 612 (including stop nodule 724 and storage nodule 726) corresponding to the location or vertical position of movable shelf 340 which is desired by user.

User can move movable shelf 340 from the fully retracted position by pressing or applying downward force to stop bar handle 720, thereby compressing spring 722 and causing all nodules 612, except stop bar nodule 724, to retract into cavity 542. This allows roller 800 to move or roll along guide surface 540 in a transverse direction T toward distal end 308 of bracket 302.

Figure 10:
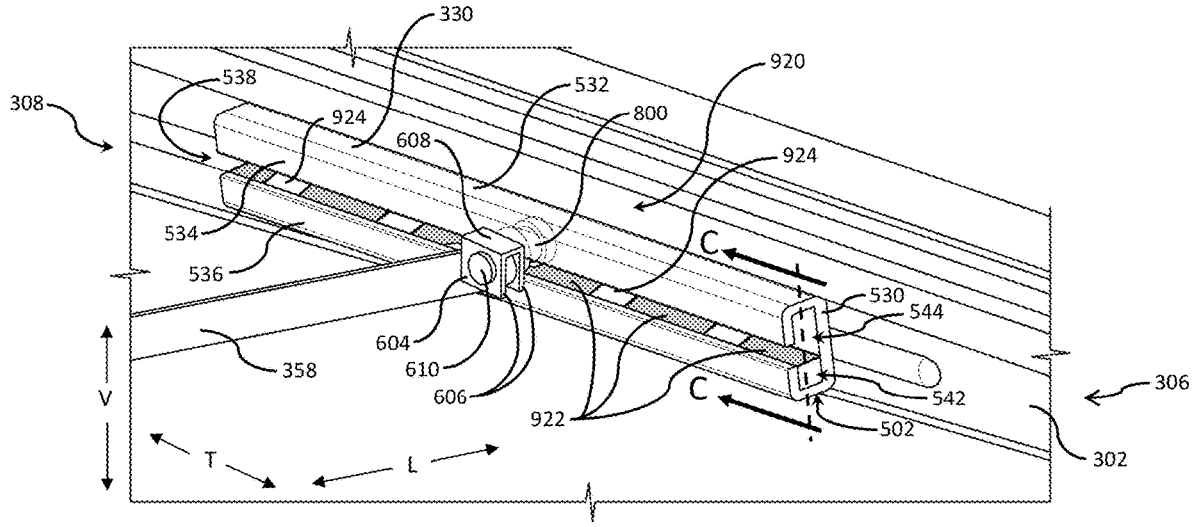
FIG. 10 depicts a partial perspective view of another exemplary embodiment of an upper guide according to an exemplary embodiment of the present disclosure which can be used with an adjustable organizer shelf, such as the adjustable organizer shelf assembly of FIG. 2.
Figure 11:
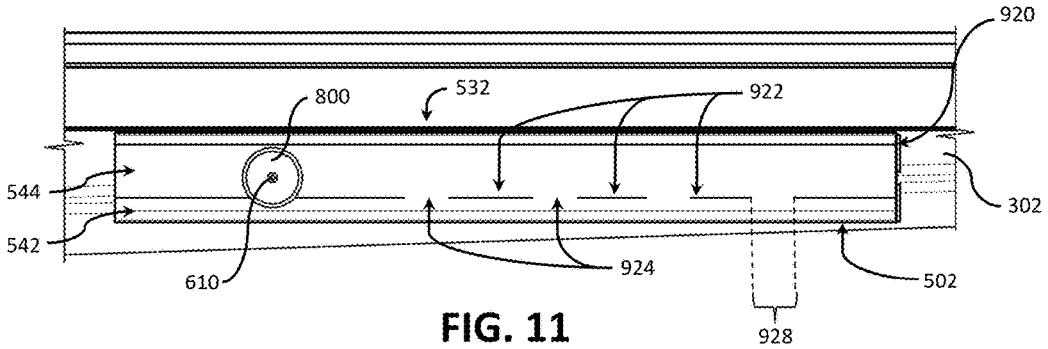
FIG. 11 depicts a side section view of the upper guide of FIG. 10 taken along the C-C section line of FIG. 10.

Referring again generally to FIGS. 10 and 11. FIG. 10 depicts a partial perspective view of another exemplary embodiment of an upper guide 920 of the present disclosure, which can be utilized with adjustable organizer shelf assembly 300, such as the adjustable organizer shelf assembly of FIG. 3, in lieu of the exemplary upper guide 330 described hereinabove. FIG. 11 depicts a side section view of the upper guide 920 of FIG. 10 taken along the C-C section line of FIG. 10.

FIG. 10 depicts a partial perspective view of an exemplary embodiment of an upper guide 920 of the present disclosure with can be utilized with an adjustable organizer shelf assembly, such as adjustable organizer shelf 300 of FIG. 2. Upper guide 920 includes a bottom member 502. In FIG. 10 upper guide 920 is affixed to right-side bracket 302. However, it should be appreciated that an upper guide 920 can also be affixed to left-side bracket 304 and have the same features described with respect to FIGS. 10 and 11. Bottom member 502 extends in a transverse direction T from the proximate end 306 of bracket 302 toward the distal end 308 of bracket 302. Each upper guide 920 includes an outside member 530 which extends upward, in a vertical direction V, from bottom member 502 and extends in a transverse direction T along bracket 302 from the proximate end 306 of bracket toward distal end 308 of bracket. Top member 532 of guide 920 extends from outside member 530 in a lateral direction L inward toward center of fixed shelf 320. Each guide 920 further includes a first inner member 534 and second inner member 536. First inner member 534 extends downward, in a vertical direction V, from top member 532. Second inner member 534 extends upward, in a vertical direction V, from bottom member 502. First inner member 534 and second inner member 536 are separated in a vertical direction V to define a slot 538. Slot 538 extends along the transverse direction T between first inner member 534 and second inner member 536. Bottom member 502 and top member 532 face each other, e.g., along the vertical direction V. Outside member 530 faces first inner member 534 and second inner member 536, e.g., along the lateral direction L. Guide 920 includes a guide surface 922 which extends between second inner member 536 and outside member 530 in the lateral direction L and the transverse direction T.

Bottom member 502, outside member 530, guide surface 540, and second inner member 512 define a cavity 542. In the embodiment depicted in FIGS. 10 and 11, cavity 542 is a square or rectangular shape, however, cavity 542 can be any other shape. Guide surface 922, outside member 530, top member 532 and first inner member 534 define a channel 544. Channel 544 extends in a transverse direction T along top surface 344 from the proximate end 306 of bracket 302 toward distal end 308 of bracket 302.

In the embodiment depicted in FIGS. 10 and 11, channel 544 is an inverted "L" shape, however, channel 544 can be any other shape configured capable of accept roller, such as roller 800. Roller 800 is depicted in further detail in FIGS. 8 and 9, however, it should be appreciated that other configurations of roller 800 can be utilized with upper guide 920, specifically a roller 800 excluding nodule reception cavities 804, so long as roller 800 is configured to roll or moving on guide service 922 and within, at least a portion of channel 544 along transverse direction T. Roller 800 is attached to upper roller hinge 604. Upper roller hinge 604 includes two side supports 606, extending downward in the vertical direction V away from fixed shelf plate 322, and a top support 608 extending between the side supports 606 to form an inverted "U" shape facing downward in vertical direction V.

Upper roller hinge 604 is configured to accept a portion of second lifting arm 358 between hinge side supports 606 and secure second lifting arm 358 to upper roller hinge 604. Each hinge side support 606 includes a pin hole (not shown) configured to allow insertion of a pin 610 through each pin hole (not shown) and through second lifting arm 358. Pin 610 mechanically attaches second lifting arm 358 and upper roller hinge 604 in such a manner as to allow second lifting arm 358 to pivot or rotate about pin 610.

Upper guide 920 includes a plurality of depression stops 924. Depression stops 924 can be a series of depressions in guide surface 922 that extend in a downward direction V toward cavity 542 from channel 544. Alternatively, depression stops 924 can be passages, gaps or holes in guide surface 922.

Depression stops 924 are sized and configured based, at least in part, on the size of roller 800. More specifically, roller has an outside diameter 926 (shown in FIG. 9). The length 928 (in the transverse direction T) of depression stops 924 is based upon outside diameter 926. More precisely, length 928 of depression stops 924 is between about 20% and about 40% of outside diameter 926 of roller 800. In this way only a portion of roller 800 can enter or rest in depression stop 924, thereby allowing a portion of roller 800 to pass into cavity 542 (as shown in FIG. 11) and thereby, prevent roller from rolling or moving along guide surface 922 within channel 544.

Roller 800 can move or roll along guide surface 922 between the plurality of depression stops 924. User can select the vertical position of movable shelf 340 relative to fixed shelf 320 by selectively engaging roller 800 with one of the plurality of depression stops 924 corresponding to the user desired location or vertical position of movable shelf 340. User can move movable shelf 340 from the fully retracted position toward the fully extend position by pressing or applying downward force to movable shelf 340, thereby causing roller 800 to move out of the depression stop 924 in which roller 800 is situated, thus forcing the entirety of roller 800 into channel 544 such that roller can move or roll along guide surface 922 in a transverse direction T toward distal end 308 of bracket 302 until roller 800 reaches another of the plurality of depression stops 924 which correspond with the user's desired location or vertical position of movable shelf 340.

Similarly user can move movable shelf 340 from the fully extended position toward the fully retracted position by pressing or applying an upward force to movable shelf 340, thereby causing roller 800 to move out of the depression stop 924 in which roller 800 is situated, thus forcing the entirety of roller 800 into channel 544 such that roller can move or roll along guide surface 922 in a transverse direction T toward proximate end 306 of bracket 302 until roller 800 reaches another of the plurality of depression stops 924 which corresponds to the user's desired location or vertical position of movable shelf 340.

Figure 12:
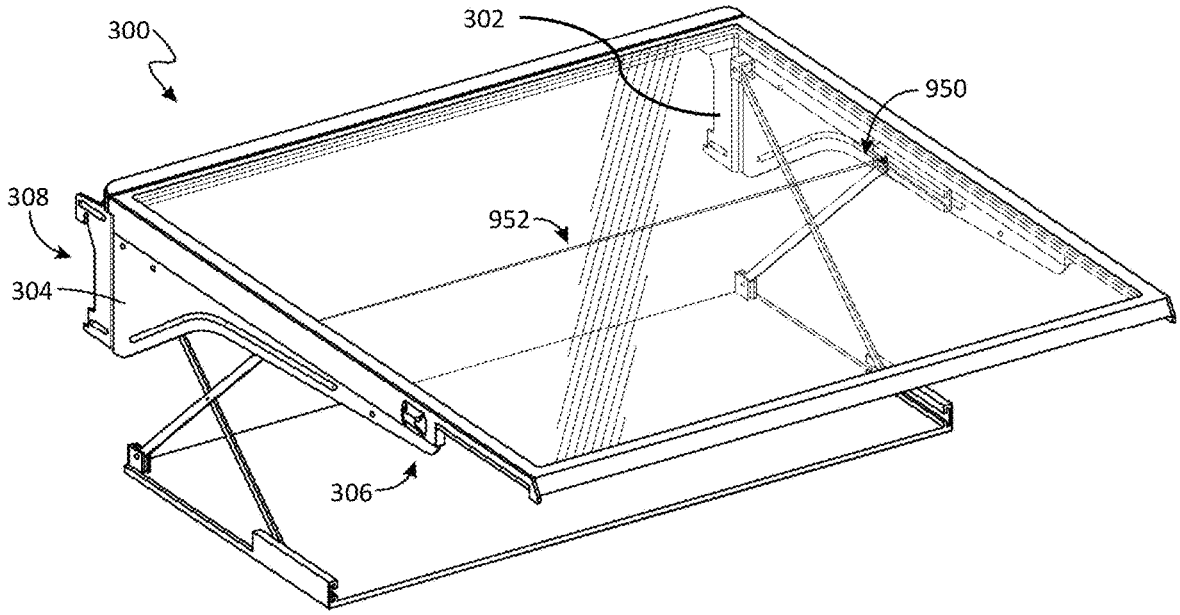
FIG. 12 depicts a partial perspective view of an adjustable organizer shelf assembly with cable stabilizer assembly according to an exemplary embodiment of the present disclosure.
Figure 13:
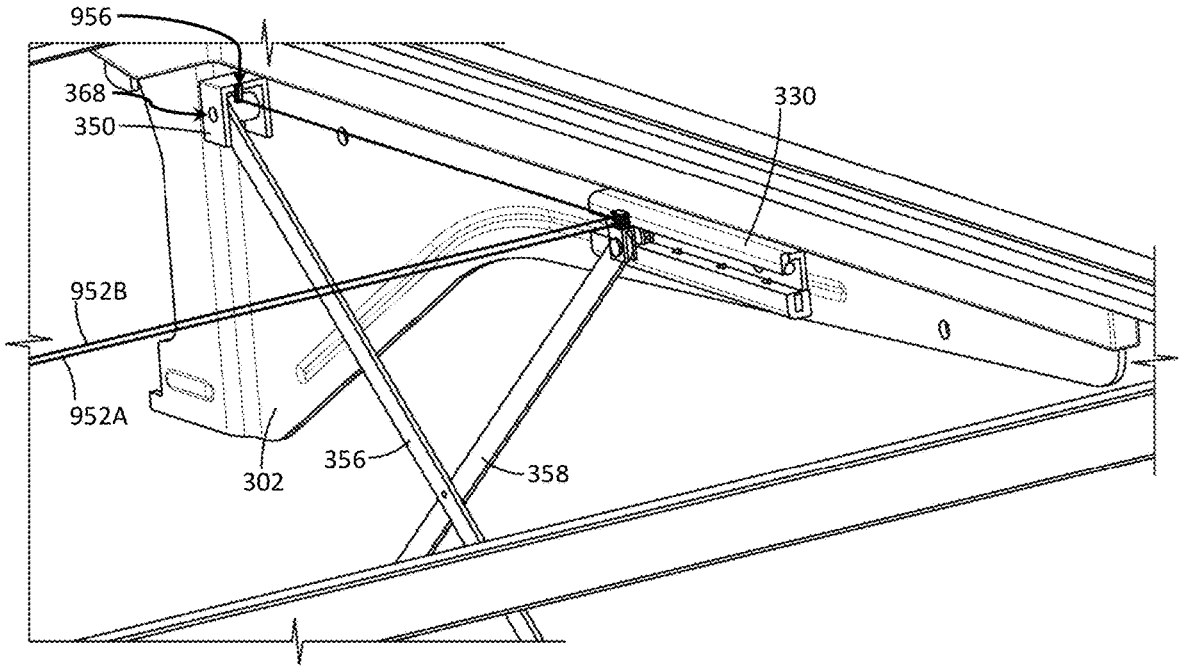
FIG. 13 depicts a partial perspective view of the cable stabilizer assembly of FIG. 12 without the inclusion of the top plate of the fixed shelf, in order to provide an unobstructed view of a portion of the cable stabilizer assembly, an upper guide, a portion of a lifting bar of a shelf assembly according to an exemplary embodiment of the present disclosure.

Referring now generally to FIGS. 12, 13, 14, 15 and 16. FIG. 12 depicts a partial perspective view of an adjustable organizer shelf assembly 300, including a cable stabilizer assembly 950 according to an exemplary embodiment of the present disclosure. FIG. 13 depicts a partial perspective view of the cable stabilizer assembly 950 of FIG. 12 without the inclusion of the fixed plate 322 of the fixed shelf 320, in order to provide an unobstructed view of a portion of the cable stabilizer assembly 950, and portions of adjustable organizer shelf assembly 300 according to an exemplary embodiment of the present disclosure.

Cable stabilizer assembly 950 is operably connected to upper guide 330 attached to right bracket 302 and upper guide 330 attached to left bracket 304 such that rollers 800 of both upper guides 330 move in substantially the same positions along a plane formed in the lateral direction L as rollers move in a transverse direction T within channels 544 of upper guides 330. In this manner, cable stabilizer assembly 950 avoids adjuster organizer shelf assembly 300 (specifically first lifting arm 356 and second lifting arm 358) from racking or twisting when movable shelf 340 is moved between the fully extended position and the fully retracted position.

Figure 15:
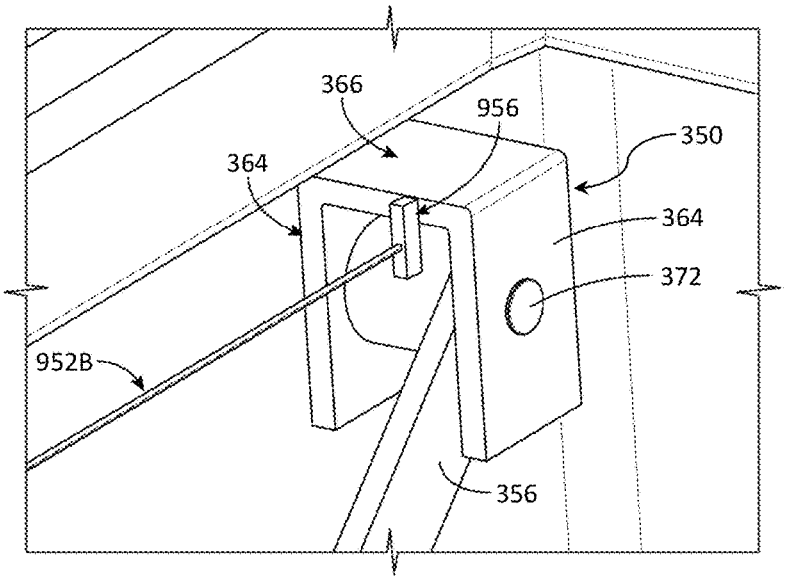
FIG. 15 depicts a perspective view of a rear upper hinge assembly and a portion of the cable stabilizer assembly of FIG. 12.

Cable stabilizer assembly 950 includes a pair of cables 952. Cables 952 can be made from metal, plastic, nylon or another similar material. Cable stabilizer assembly 950 includes a plurality of cable clips 956 which include a slot configured to accept and secure cables 952. As depicted in FIG. 15, cable clips 956 are affixed to rear upper hinges 350 and upper guides 330 by a known fastening method, e.g., welding, adhesive, screws and/or bolts. Alternatively, cable clips 956 can be integrally formed with rear upper hinges 350 and upper guides 330. Cable stabilizer assembly includes a cable pulley assembly 954.

Figure 14:
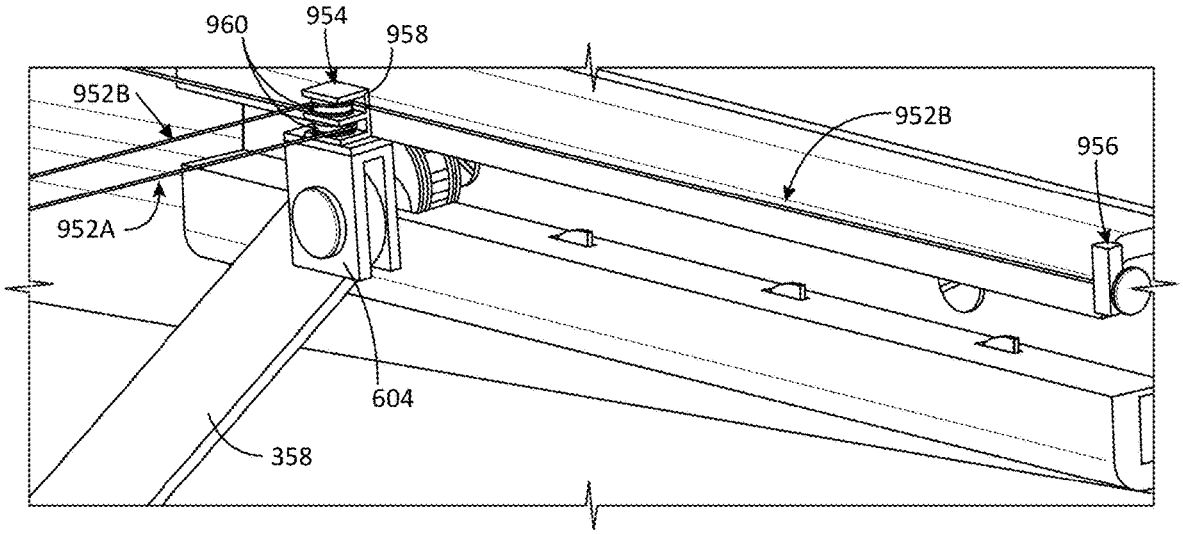
FIG. 14 depicts a partial perspective view of the cable stabilizer assembly of FIG. 12 without the inclusion of certain components, in order to provide an unobstructed view of a portion of the cable stabilizer assembly, an upper guide, and a portion of a lifting bar of the shelf assembly according to an exemplary embodiment of the present disclosure.

As detailed in FIG. 14, cable pulley assembly 954 includes a pulley bracket 958 and a pair of pulley wheels 960. Cable pulley assembly 954 is affixed or mounted to upper roller hinge 604. Cable pulley assembly 954 is affixed or mounted to upper roller hinge 604 by a known fastening method, e.g., welding, adhesive, screws and/or bolts. Alternatively, pulley bracket 958 of cable pulley assembly 954 can be integrally formed with upper roller hinge 604. Cables 952 ride along pulley wheels 960 when movable shelf 340 is moved between the fully extend position and fully retracted position.

Figure 16:
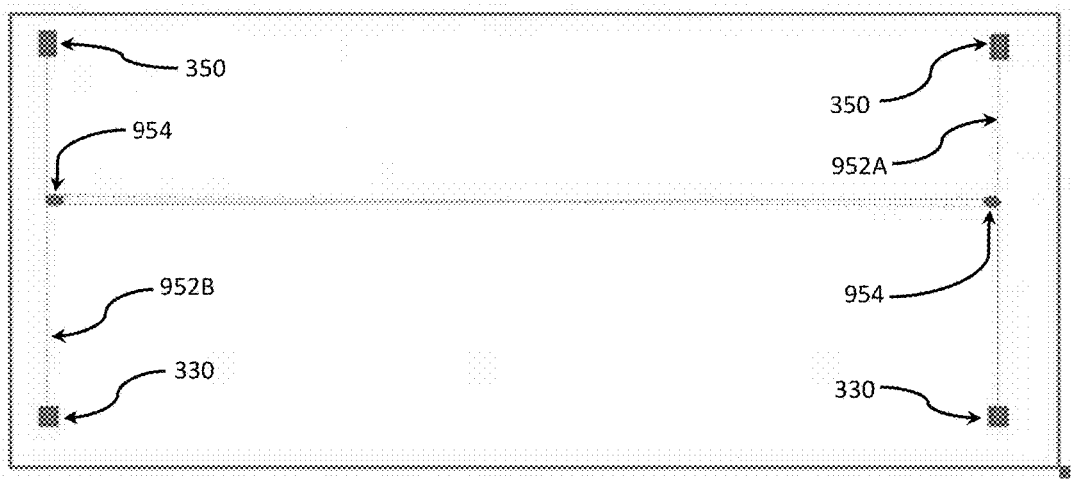
FIG. 16 depicts a schematic view of a configuration of the cables of the cable stabilizer assembly of FIG. 12.

FIG. 16 depicts a schematic view of a configuration of the cables 952 of the cable stabilizer assembly of FIGS. 12 through 15. As shown in FIG. 16, a first of the pair of cables 952 (i.e., first cable 952A) extends from cable clip 956 affixed to rear upper hinge 350 attached to bracket 302, to cable pulley assembly 954 affixed to upper roller hinge 604 attached to bracket 302, to cable pulley assembly 954 affixed to upper roller hinge 604 attached to bracket 304 and lastly to cable clip 956 affixed to guide 330 attached to bracket 304. Conversely the second of the pair of cables 952 (i.e., second cable 952B) extends from cable clip 956 affixed to rear upper hinge 350 located attached to bracket 304, to cable pulley assembly 954 affixed to upper roller hinge 604 attached to bracket 304, to cable pulley assembly 954 affixed to upper roller hinge 604 attached to bracket 302 and lastly to cable clip 956 affixed to guide 330 attached to bracket 302.

Figure 17:
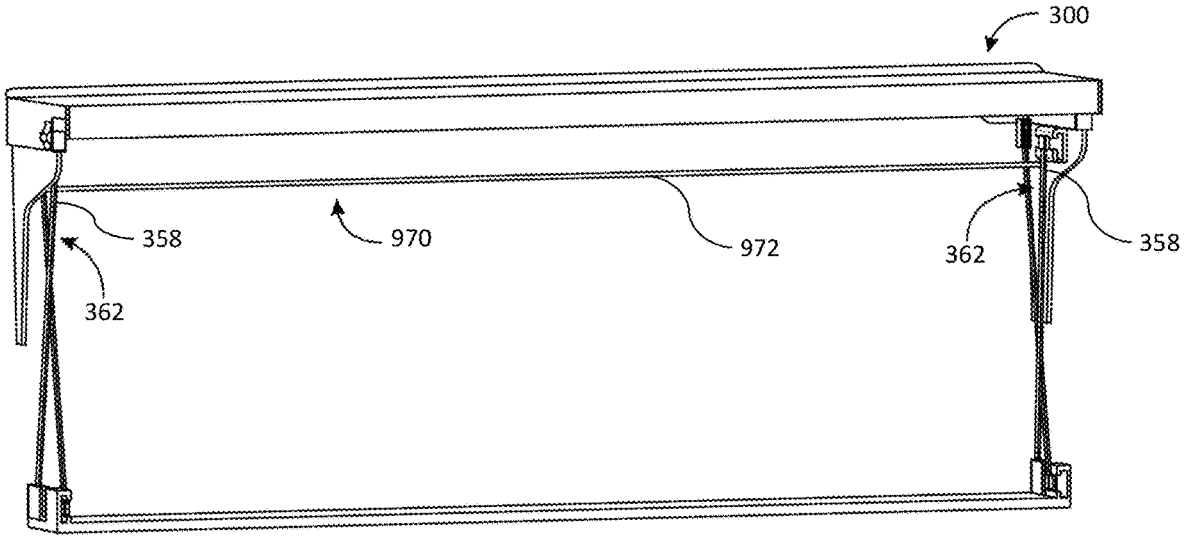
FIG. 17 depicts a partial perspective view of an adjustable organizer shelf assembly with a bar stabilizer assembly according to an exemplary embodiment of the present disclosure.
Figure 18:
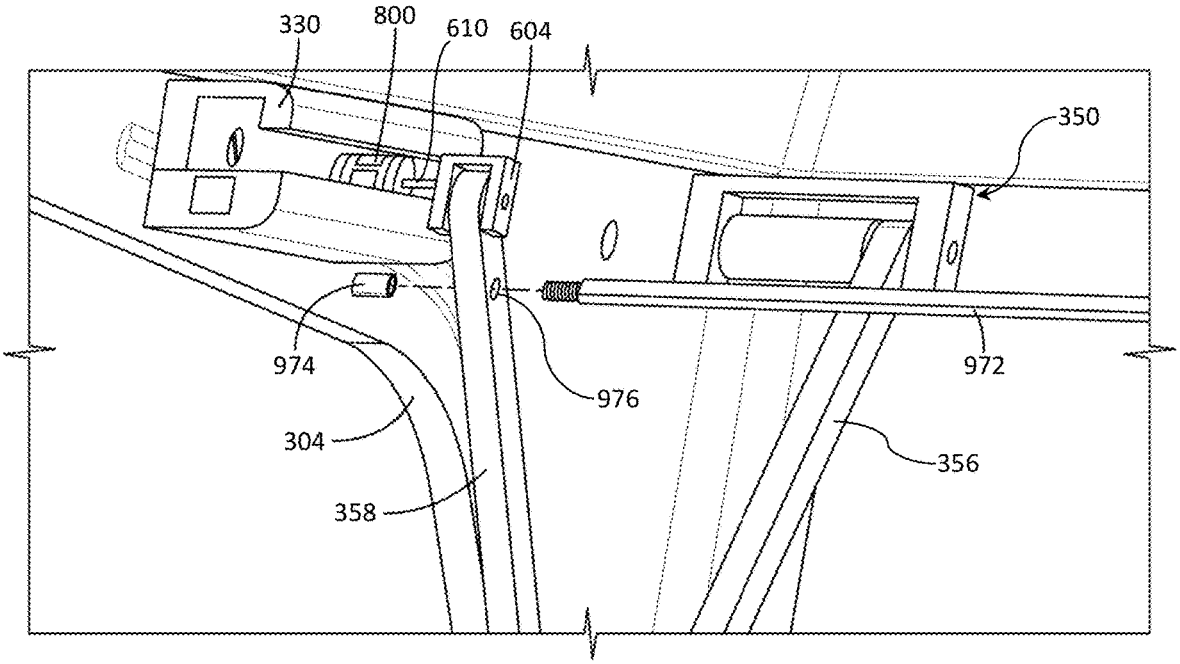
FIG. 18 depicts a partial perspective view of the bar stabilizer assembly of FIG. 17 with an embodiment of exemplary attachment components.

Referring now generally to FIGS. 17 and 18. FIG. 17 depicts a partial perspective view of an adjustable organizer shelf assembly 300 with a bar stabilizer assembly 970 according to an exemplary embodiment of the present disclosure. FIG. 18 depicts a partially exploded perspective view of a portion of the bar stabilizer assembly 970 of FIG. 17. Bar stabilizer assembly 970 includes a bar 972 which extends in a lateral direction between second lifting arm 358 that is movably attached to the upper guide 300 which attached to bracket 304 and second lifting arm 358 that is movably attached to the upper guide 300 which is attached to bracket 302. Bar 972 can be metal, plastic or another suitable rigid material. Bar 972 is attached to each second lifting arm 358 at a mounting hole 976 located near upper roller hinge 604, so that bar 972 does not interfere with storage of food items on movable shelf 340. Bar 972 can be attached to each of the second lifting arm 358 by a pin, screws and/or bolts. Bar 972 can include a bushing 974 which is positioned around stabilizer bar and between second lifting arm 358 to reduce movement, binding or rattling of stabilizer bar 972 when it is affixed to second lifting arms 358.

Bar stabilizer assembly 970 is operably connected to second lifting arm 358 which is movably attached to upper guide 330 that is attached to bracket 304 and second lifting arm 358 which is movably attached to upper guide 330 that is attached to bracket 302 such that rollers 800 of both guides 330 move in substantially the same positions along a plane formed in the lateral direction L as rollers 800 move in a transverse direction T within channels 544 of guides 330. In this manner, bar stabilizer assembly 970 prevents adjustable organizer shelf assembly 300, and specifically second lifting arms 358, from racking or twisting when movable shelf 340 is moved between the fully extended position and the fully retracted position.

Figure 19:
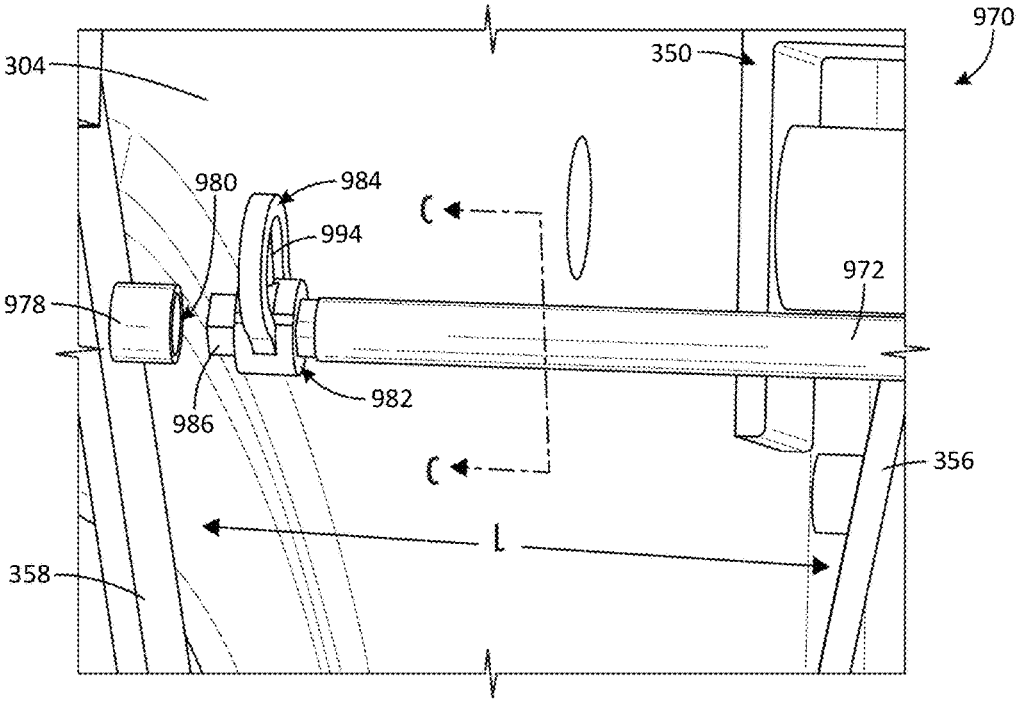
FIG. 19 depicts a partially exploded perspective view of another example configuration of the bar stabilizer assembly of FIG. 17.
Figure 20:
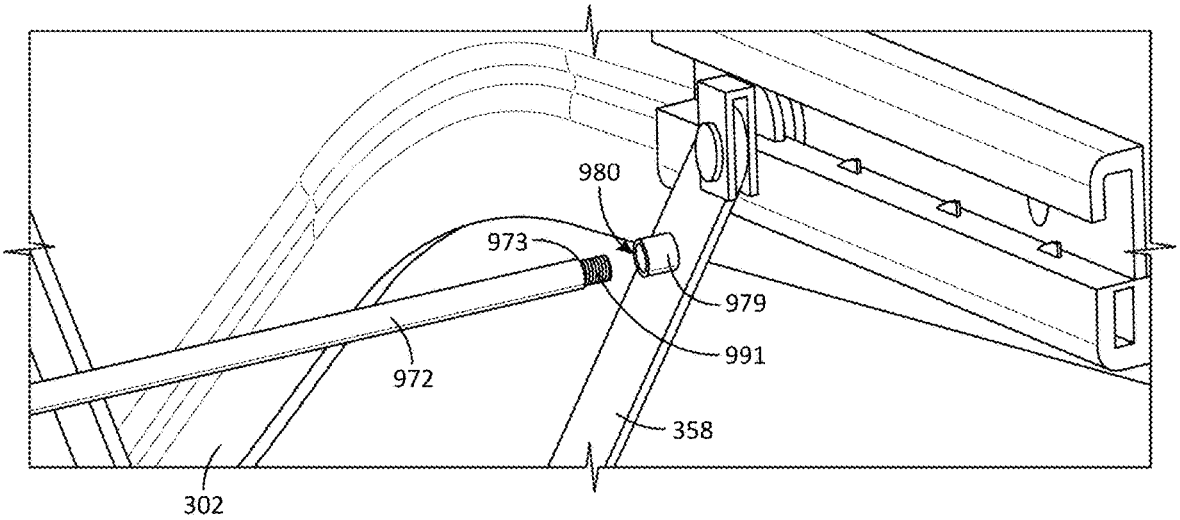
FIG. 20 depicts a partially exploded perspective view of a portion of the bar stabilizer of FIG. 19.
Figure 21:
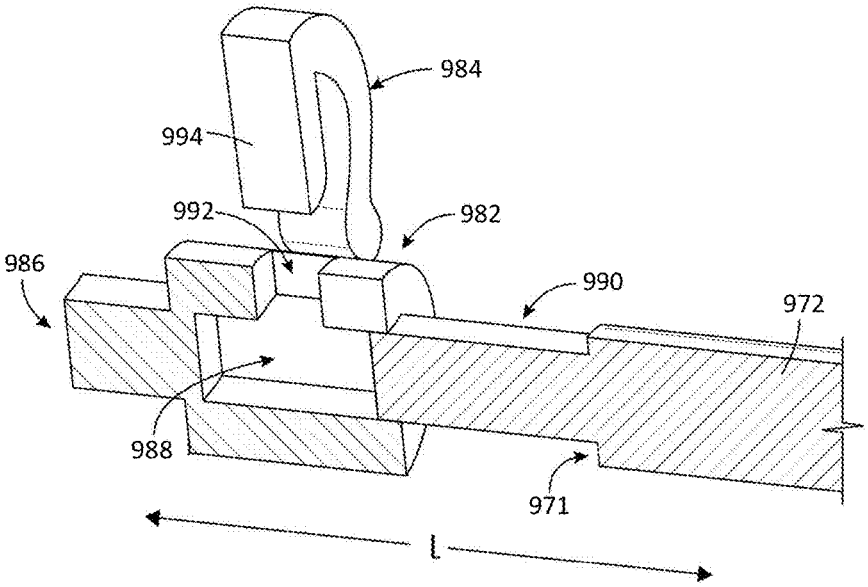
FIG. 21 depicts a partial section view of a portion of the bar stabilizer assembly of FIG. 19 taken along the C-C section line of FIG. 19.

Referring now generally to FIGS. 19, 20 and 21. FIG. 19 depicts a partial perspective view of another example embodiment of a bar stabilizer assembly 970, with alternate attachment components depicted for affixing stabilizer bar 972 to each of the two second lifting arms 358 according to another exemplary embodiment of the present disclosure. FIG. 20 depicts a partially exploded perspective view of a portion of the bar stabilizer assembly 970 of FIG. 19. FIG. 21 depicts a partial section view of the bar stabilizer assembly 970 of FIG. 19 taken along the C-C section line of FIG. 19.

Bar stabilizer assembly 970 includes a bar 972 which extends in a lateral direction between the second lifting arm 358 which is movably attached to the guide 330 that is attached to bracket 304 and the second lifting arm 358 which is movably attached to the guide 330 that is attached to bracket 302 (as shown in FIG. 17). Bar 972 can be metal, plastic or another suitable rigid material. Bar 972 is attached to each second lifting arm 358 at a location near upper roller hinge 604, such that bar 972 does not interfere with storage of food items on movable shelf 340. Bar stabilizer assembly 970 can include a first mounting nodule 978 affixed to one of the second lifting arms 358 and a second mounting nodule 979. First mounting nodule 978 and second mounting nodule 979 can be a protrusion, such as the cylindrical protrusion shown in FIGS. 19 and 20, which extends away from each of the two second lifting arms 358 in a lateral direction L inward toward center of fixed shelf 320. First mounting nodule 978 forms a cavity or void 980. Second mounting nodule 979 forms a cavity or void 980. Mounting nodules 978 and 979 can be made of any suitable material, such as metal or plastic. Mounting nodules 978 and 979 can be attached to each of the respective second lifting arms 358 by welding, adhesive, or other known methods of attachment. Alternatively, mounting nodules 978 and 979 can be integrally formed as a single piece with each of the second lifting arms 358.

Bar stabilizer assembly 970 includes a mounting coupler 982 and a clip 984 situated at a first end 971 of bar 972. Mounting coupler 982 includes a coupler protrusion 986. Coupler protrusion 986 and mounting nodule void 980, of first mounting nodule 978, have corresponding shapes and dimensions such that coupler protrusion 986 may be inserted partially or completely within mounting nodule void 980 of first mounting nodule 978. Mounting coupler 982 forms a cavity or void 988. Stabilizer bar 972 includes a first mounting protrusion 990 at first end 971 of stabilizer bar 972 and a second mounting protrusion 991 at a second end 973 of stabilizer bar 972. First mounting protrusion 990 and second mounting protrusion 991 extend from stabilizer bar 972 in a lateral direction L toward one of each of the mounting nodules 978 and 979. First mounting protrusion 990 and mounting coupler void 988 have corresponding shapes and dimensions such that first mounting protrusion 990 may move in a lateral direction within coupler void 988. First mounting protrusion 990 can be inserted partially or disposed entirely within mounting collar void 988. Second mounting protrusion 991 and mounting nodule void 980 of second mounting nodule 979 have corresponding shapes and dimensions such second mounting protrusion 991 may be inserted partially or completely within mounting nodule void 980 of second mounting nodule 979.

Mounting coupler 982 includes a clip passage 992. Clip 984 includes a locking member 994. Clip can be attached around coupler 982 such that locking member 994 passes through clip passage 992 and extends into the mounting coupler void 988. When locking member 994 extends into mounting coupler void 988, locking member 994 to prevents first mounting protrusion 990 from moving in a lateral direction L within coupler void 988 toward coupler protrusion 986. In this manner first mounting protrusion 990 cannot be disposed entirely within mounting coupler void 988. Locking member 994 prevents first mounting protrusion 990 from moving into collar void 988 past clip cavity 992 in a lateral direction L toward collar protrusion 986.

Second mounting protrusion 991 can be inserted into nodule void 980 of the second mounting nodule 979 which is affixed to one of the second lifting arms 358 as shown in FIG. 20. When second mounting protrusion 991 at the second end of bar 973 is inserted within nodule void 980 of second mounting nodule 979, and first mounting protrusion 990 is completed disposed within collar void 988, no portion of the coupler mounting protrusion 986 is disposed within the mounting nodule void 980 of first mounting nodule 978. In this way the bar 972 can be positioned between each of the two second lifting arms 358 without bending. Mounting coupler 982 can be then be moved in a lateral direction L so that the coupler protrusion 986 is inserted within the nodule void 980 of the first mounting nodule 978 and the path between clip passage 992 and mounting coupler void 988 is not obstructed by any portion of first mounting protrusion 990. When the clip 984 is attached to the mounting coupler 982 so that at least a portion of the locking member 994 is disposed within the coupler void 988, locking member 994 prevents bar 972 from moving in a lateral direction such that that at least a portion of mounting coupler protrusion 986 remains at least partially inserted or partially disposed within the nodule void 980 of the first mounting nodule 978, at least a portion of the first mounting protrusion 990 remains inserted or partially disposed within the mounting collar void 988 and at least a portion of second mounting protrusion 991 remains at least partially inserted or partially disposed within the nodule void 980 of the second mounting nodule 979.

In this way bar stabilizer assembly 970 depicted in FIGS. 19, 20 and 21 is operably connected to second lifting arm 358 which is movably attached to upper guide 330 that is attached to bracket 304 and second lifting arm 358 which is movably attached to upper guide 330 that is attached to bracket 302 such that rollers 800 of both guides 330 move in substantially the same positions along a plane formed in the lateral direction L as rollers 800 move in a transverse direction T within channels 544 of guides 330. In this manner, bar stabilizer assembly 970 prevents adjustable organizer shelf assembly 300, and specifically second lifting arms 358, from racking or twisting when movable shelf 340 is moved between the fully extended position and the fully retracted position.

It should be appreciated that the stabilizer assemblies described are only exemplary and that other stabilizer mechanisms may be used according to alternative embodiments.

Although specific features of various embodiments may be shown in some drawings and not in others, this is for convenience only. In accordance with the principles of the present disclosure, any feature of a drawing can be referenced and/or claimed in combination with any feature of any other drawing.

This written description uses examples for the disclosure, including the best mode, and also to enable any person skilled in the art to practice the disclosure, including making and using any devices or systems and performing any incorporated methods. The patentable scope of the disclosure is defined by the claims, and can include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An adjustable organizer shelf assembly for a consumer appliance, the shelf assembly defining a vertical direction, a lateral direction, and a transverse direction, the vertical, lateral, and transverse directions being mutually perpendicular, the shelf assembly comprising:

a first bracket and a second bracket;

a fixed shelf mounted to the first bracket and the second bracket;

a movable shelf having a first rear lower hinge, a second rear lower hinge, a first lower guide and a second lower guide;

a first lifting arm assembly movably attaching the movable shelf to the first bracket, wherein the first lifting arm assembly includes a plurality of lifting arms, a first upper rear hinge affixed to the first bracket, a first upper guide affixed to the first bracket, and a roller disposed within each of the first upper guide and the first lower guide, wherein the first upper guide includes a channel, a guide surface disposed with the channel, a cavity disposed within the channel, said cavity being formed, at least in part, by the guide surface, a plurality of passages formed in the guide surface, a stop bar disposed within the cavity, a plurality of nodules affixed to said stop bar, and wherein the nodules project through said passages from the cavity into the channel;

a second lifting arm assembly movably attaching the movable shelf to the second bracket, wherein the second lifting arm assembly includes a plurality of lifting arms, a second upper rear hinge affixed to the second bracket, a second upper guide affixed to the second bracket, and a roller disposed within each of the second upper guide and the second lower guide; and a stabilizer assembly extending between the first lifting arm assembly and the second lifting arm assembly.

2. The adjustable organizer shelf assembly of claim 1, wherein the roller disposed within the first upper guide further comprises:

a first circumferential edge and a second circumferential edge; and a plurality of nodule reception cavities disposed between said first and second circumferential edges.

3. The adjustable organizer shelf assembly of claim 2, wherein the roller disposed within the first upper guide further comprises:

a striking surface and a holding surface disposed within each of the plurality of nodule reception cavities.

4. The adjustable organizer shelf assembly of claim 3, wherein the stabilizer assembly comprises a cable stabilizer assembly.

5. The adjustable organizer shelf assembly of claim 3, wherein the stabilizer assembly comprises a bar stabilizer assembly.

6. A refrigerator appliance, the refrigerator appliance defining a vertical direction, a lateral direction, and a transverse direction, the vertical, lateral, and transverse directions being mutually perpendicular, the refrigerator appliance comprising:

a cabinet defining a chilled chamber;

a door being operably coupled to the cabinet to provide selective access to the chilled chamber; and an adjustable organizer shelf assembly positioned within the chilled chamber, wherein the adjustable organizer shelf assembly comprising:

a right bracket and a left bracket;

a fixed shelf mounted to said right bracket and left bracket;

a movable shelf having a first rear lower hinge, a second rear lower hinge, a first lower guide and a second lower guide;

a first lifting arm assembly movably attaching the movable shelf to the right bracket, wherein the first lifting arm assembly includes a plurality of lifting arms, a first upper rear hinge affixed to the right bracket, a first upper guide affixed to the right bracket, and a roller disposed within each of the first upper guide and the first lower guide, wherein the first upper guide includes a channel, a guide surface disposed with the channel, a cavity disposed within the channel, said cavity being formed, at least in part, by the guide surface, a plurality of passages formed in the guide surface, a stop bar disposed within the cavity, a plurality of nodules affixed to said stop bar, and wherein the nodules project through said passages from the cavity into the channel;

a second lifting arm assembly movably attaching the movable shelf to the left bracket, wherein the second lifting arm assembly includes a plurality of lifting arms, a second upper rear hinge affixed to the left bracket, a second upper guide affixed to the left bracket, and a roller disposed within each of the second upper guide and the second lower guide; and a stabilizer assembly extending between the first lifting arm assembly and the second lifting arm assembly.

7. The refrigerator appliance of claim 6, wherein the roller disposed within the first upper guide further comprises:

a first circumferential edge and a second circumferential edge; and a plurality of nodule reception cavities disposed between said first and second circumferential edges.

8. The refrigerator appliance of claim 7, wherein the roller disposed within the first upper guide further comprises:

a striking surface and a holding surface disposed within each of the plurality of nodule reception cavities.

9. The refrigerator appliance of claim 8, wherein the stabilizer assembly comprises a cable stabilizer assembly.

10. The refrigerator appliance of claim 9, wherein the cable stabilizer assembly further comprises:

a first cable;

a second cable;

a first cable pulley assembly affixed to the first lifting arm assembly;

a second cable pulley assembly affixed to the second lifting arm assembly; and wherein the first cable extends from a cable clip affixed to the first rear upper hinge affixed to the right bracket, to first cable pulley assembly, to second cable pulley assembly and to a cable clip affixed to second upper guide affixed to the left bracket, and wherein the second cable extends from a cable clip affixed to the second rear upper hinge affixed to the left bracket, to second cable pulley assembly, to first cable pulley assembly and to a cable clip affixed to first upper guide affixed to the right bracket.

11. The refrigerator appliance of claim 6, wherein the stabilizer assembly comprises a stabilizer bar attached to at least one of the lifting arms of both the first lifting arm assembly and the second lifting arm assembly.

12. The refrigerator appliance of claim 11, wherein the stabilizer assembly further comprises:

a mounting nodule attached to at least one of the lifting arms of both the first lifting arm assembly and the second lifting arm assembly;

a mounting coupler including a clip passage; and a clip including a locking member.

13. A shelf assembly, the shelf assembly defining a vertical direction, a lateral direction, and a transverse direction, the vertical, lateral, and transverse directions being mutually perpendicular, the shelf assembly comprising:

a pair of brackets comprising a first bracket and a second bracket;

a fixed shelf mounted to said pair of brackets;

a first rear upper hinge mounted to the first bracket;

a second rear upper hinge mounted to the second bracket a first upper guide mounted to the first bracket;

a second upper guide mounted to the second bracket;

a movable shelf having a pair of rear lower hinges and a pair of lower guides;

a roller disposed within each of the first upper guide and the second upper guide;

a roller disposed within each of the lower guides;

a first lifting arm assembly attached to the first bracket and a second lifting arm assembly attached to the second bracket, said first lifting arm assembly and said second lifting arm assembly each including a first lifting arm and a second lifting arm, wherein said first lifting arm and said second lifting arm of each of the first lifting arm assembly and the second lifting arm assembly is mechanically attached at a pivot joint, and wherein the first lifting arm of the first lifting arm assembly is attached to the first rear upper hinge and the roller disposed within one of the pair of lower guides, and the first lifting arm of the second lifting arm assembly is attached to the second rear upper hinge and the roller disposed within one of the pair of lower guides, and each of the second lifting arms of the first lifting arm assembly and the second lifting arm assembly is attached to a rear lower hinge and the roller disposed within one of the first upper guide and the second upper guide; and a cable stabilizer assembly further comprising a first cable, a second cable, a first cable pulley assembly affixed to the first lifting arm assembly, a second cable pulley assembly affixed to the second lifting arm assembly; and wherein the first cable extends from a first cable clip, affixed to the first rear upper hinge, to the first cable pulley assembly, to the second cable pulley assembly and to a second cable clip affixed to second upper guide, and wherein the second cable extends from a third cable clip affixed to the second rear upper hinge, to the second cable pulley assembly, to the first cable pulley assembly and to a fourth cable clip affixed to first upper guide.

* * * * *